US009360247B2

(12) United States Patent
Park et al.

(10) Patent No.: US 9,360,247 B2
(45) Date of Patent: Jun. 7, 2016

(54) AIRTIGHT CONTAINER FOR REFRIGERATOR AND REFRIGERATOR INCLUDING THE SAME

(71) Applicant: LG Electronics Inc., Seoul (KR)

(72) Inventors: Ahreum Park, Seoul (KR); Sanggyun Lee, Seoul (KR); Yongjoo Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/289,164

(22) Filed: May 28, 2014

(65) Prior Publication Data

US 2014/0354134 A1 Dec. 4, 2014

(30) Foreign Application Priority Data

May 28, 2013 (KR) ..... 10-2013-0060553
May 28, 2013 (KR) ..... 10-2013-0060554

(51) Int. Cl.

| | |
|---|---|
| ***A47B 96/04*** | (2006.01) |
| ***F25D 23/12*** | (2006.01) |
| ***F25D 25/02*** | (2006.01) |
| ***F25D 23/02*** | (2006.01) |
| ***F25D 23/04*** | (2006.01) |

(52) U.S. Cl.

CPC ..... *F25D 23/12* (2013.01); *F25D 23/028* (2013.01); *F25D 23/04* (2013.01); *F25D 25/025* (2013.01); *F25D 2317/043* (2013.01); *F25D 2317/061* (2013.01)

(58) Field of Classification Search

CPC ..... F25D 2317/043
USPC ..... 62/268; 312/333, 402, 404
See application file for complete search history.

(56) References Cited

U.S. PATENT DOCUMENTS

| | | | | |
|---|---|---|---|---|
| 2,116,813 | A * | 5/1938 | O'N. Weisser | A23B 4/066 292/DIG. 71 |
| 2,119,320 | A * | 5/1938 | Dobrowsky | F25D 17/047 292/DIG. 71 |
| 5,271,240 | A * | 12/1993 | Detrick | F25D 17/042 62/268 |
| 6,090,422 | A | 7/2000 | Taragan et al. | |
| 6,598,517 | B1 * | 7/2003 | McCausland | A23L 3/3418 141/65 |
| 7,107,780 | B2 * | 9/2006 | Bellini | F25D 17/047 137/533.27 |
| 2003/0184196 | A1 * | 10/2003 | Hung | G11B 33/124 312/332.1 |
| 2008/0134706 | A1 * | 6/2008 | Manzo | F25D 17/042 62/337 |
| 2011/0289957 | A1 * | 12/2011 | Kim | F25D 17/042 62/404 |

FOREIGN PATENT DOCUMENTS

| | | | |
|---|---|---|---|
| CN | 102338542 | A | 2/2012 |
| JP | 5474363 | U | 5/1979 |
| KR | 1019990033606 | A | 5/1999 |
| KR | 100500961 | B1 | 7/2005 |
| KR | 1020100043174 | A | 4/2010 |
| WO | 2012010505 | A1 | 1/2012 |

* cited by examiner

*Primary Examiner* — Matthew Ing
(74) *Attorney, Agent, or Firm* — Dentons US LLP

(57) ABSTRACT

A refrigerator includes a case, a drawer, and a ventilation port opening/closing member. The case has a storage space formed therein and the drawer stores food and opens and closes the storage space while being supported by the case so as to be movable with respect to the case. The ventilation port opening/closing member ventilates the storage space. Here, the drawer includes a ventilation port for ventilating the storage space, and the ventilation port opening/closing member moves in the direction as the drawer to open and close the ventilation port.

20 Claims, 20 Drawing Sheets

AIRTIGHT CONTAINER FOR REFRIGERATOR AND REFRIGERATOR INCLUDING THE SAME

CROSS-REFERENCE TO RELATED APPLICATION

This application claims the priority benefit of Korean Patent Application No. 10-2013-0060553, filed on May 28, 2013 and Korean Patent Application No. 10-2013-0060554 filed on May 28, 2013 in the Korean Intellectual Property Office, the disclosure of which is incorporated herein by reference.

BACKGROUND OF THE DISCLOSURE

1. Field of the Disclosure

The present disclosure relates to an airtight container for a refrigerator and a refrigerator including the airtight container, and more particularly, to an airtight container for a refrigerator and a refrigerator including the airtight container, which can be easily opened even when the airtight container is in a weak vacuum state.

2. Background

Generally, a refrigerator is an apparatus that supplies cold air generated through a freezing cycle into the storage compartments and lowers the temperature of the inside of the storage compartments to maintain the freshness of various foods for a long period of time.

Recently, the refrigerator is equipped with a separate storage compartment optimized for the characteristics of foods in addition to typical refrigeration compartment and freezer compartment. For example, an airtight container is provided to maintain the optimal freshness of vegetables for a long period.

A typical airtight container includes a case supplied with cold air and a drawer withdrawably disposed in the case and storing vegetables. In order to maintain the freshness of vegetables, when the drawer is in an insertion state into the case (i.e., when the airtight container is in a closed state), the airtightness of the airtight container has to be maintained. To this end, a vacuum pump may be further provided to maintain the inside of the airtight container at a weak vacuum state or low pressure state. In this case, a user needs to release the weak vacuum state of the airtight container to take vegetables out of the airtight container.

In a related art, a ventilation port is provided in the drawer to communicate between the inside and the outside of the airtight container, and an operation handle is provided to allow a user to control the ventilation port. However, in this structure, since the directions of the operation of the operation handle and the movement of the drawer are different from each other, there is a limitation in that the drawer has to be withdrawn in a straight-line direction after the weak vacuum state inside the airtight container is released by rotating the operation handle to take vegetables out of the airtight container.

FIG. 23 is a perspective view showing a related art airtight container or vegetable container 1000 for refrigerators. The related art vegetable container 1000 includes a case 1100 and a drawer 1300.

In a case in which the related art vegetable container 1000 is configured to have a two-box type structure, the drawer 1300 is inserted into the case 1100 in a drawer fashion. As a result, the interior of the vegetable container 1000 is hermetically sealed such that the interior of the vegetable container 1000 can be in a low vacuum state to improve freshness of the vegetables stored in the vegetable container 1000.

In the related art two-box type structure, the drawer 1300 hermetically seals the interior of the vegetable container 1000 such that foods can be stored in the vegetable container 1000 in a fresh state for a long period of time. A vacuum pump is mounted in the hermetical sealing drawer 1300 or the vegetable container 1000 to uniformly maintain vacuum in the vegetable container 1000 such that foods can be stored in the vegetable container 1000 in a fresh state for a long period of time.

In this case, however, an opening of the case 1100, through which the drawer 1300 is inserted into the case 1100, may be deformed toward the interior of the case 1100 due to the difference in pressure between the inside and the outside of the case 1100.

In a case in which the case 1100 is deformed, hermetical sealing between the drawer 1300 and the case 1100 may be released with the result that external air may be introduced into the case 1100 and, therefore, the low vacuum state in the case 1100 may be released.

In addition, when temperature in the case 1100 is lowered, dew may be formed in the case 1100.

The dew formed in the case 1100 may stay on the inner surface of the case 1100 with the result that the dew may be observed by the naked eye.

Furthermore, in a case in which the dew formed in the case 1100 drops and contacts foods stored in the vegetable container 1000, the food may become soft.

In addition, the dew formed in the case 1100 may not be discharged out of the case 1100.

Furthermore, when the inside of the case 1100 becomes a weak vacuum state, even an adult may not easily open the drawer 1300 due to a pressure difference between the inside and the outside of the case 1100.

SUMMARY

An airtight container for a refrigerator and a refrigerator including the airtight container, can be easily opened even when the airtight container is in a weak vacuum state.

The airtight container for a refrigerator and a refrigerator including the airtight container, can maintain a weak vacuum state in the airtight container.

The airtight container for a refrigerator and a refrigerator including the airtight container, prevents a user from observing dew generated in the airtight container for the refrigerator with the naked eyes and guides dew into a water collection part.

The airtight container for a refrigerator and a refrigerator including the airtight container, can simply discharge dew generated inside the airtight container.

According to one aspect, there is provided a refrigerator comprising: a case having a storage space formed therein; a drawer storing food and opening and closing the storage space while being supported by the case so as to be movable with respect to the case, the drawer comprising a ventilation port to ventilate the storage space; and a ventilation port opening/closing member, the ventilation port opening/closing member moves in the direction as the drawer to open and close the ventilation port.

In one embodiment, the ventilation port opening/closing member may be movably supported by the drawer.

In one embodiment, after the ventilation port is opened by the moving of the ventilation port opening/closing member, the drawer may move together with the ventilation port opening/closing member by a force acting on the ventilation port opening/closing member.

In one embodiment, the ventilation port opening/closing member may include a sealing protrusion that is inserted into the ventilation port to seal the storage space, and the sealing protrusion may be withdrawn from the ventilation port according to a movement of the ventilation port opening/closing member.

In one embodiment, the refrigerator may further include an elastic member that elastically supports the ventilation port opening/closing member.

In one embodiment, the elastic member may be elastically deformed when the ventilation port opening/closing member is moved by a force and the sealing protrusion is withdrawn from the ventilation port, and when the force applied to the ventilation port opening/closing member is removed, the ventilation port opening/closing member may be restored to an original location by a restoring force of the elastic member.

In one embodiment, the elastic member may connect the ventilation port opening/closing member and the drawer.

In one embodiment, the case may have an opening. The drawer may include: a receiving part forming a receiving space for stored goods and inserted into the opening to be supported; and an airtight container door disposed at a front side of the receiving part to open and close the opening. The airtight container door may include: a door frame having a rear surface covering the opening; and a door panel disposed at a front surface of the door frame. The ventilation port may be formed in the door frame. The sealing protrusion may be moved at a rear side of the door panel and may be covered by the door panel so as not to be exposed to the outside.

In one embodiment, the refrigerator may further include a sealer formed of a flexible material and having a tubular shape inserted into the ventilation port. Here, the sealing protrusion is inserted into the sealer.

In one embodiment, the sealer may have one end facing the storage space and includes one or more cut portions thereof.

In one embodiment, the ventilation port opening/closing member may include: a grip part vertically extending from a location laterally spaced from the sealing protrusion; and a connection part connecting the sealing part and the grip part in a lateral direction.

In one embodiment, the grip part may include a stopping protrusion formed on a rear portion thereof and having a curved shape at a contact portion with a finger to allow the finger of a user to grip the grip part.

In one embodiment, the ventilation port opening/closing member may include a support protrusion protruding downward, and the drawer may have a guide groove formed to support the support protrusion and guide a movement of the support protrusion.

In one embodiment, when the ventilation port opening/closing member is pulled, the ventilation port opening/closing member may be moved independently of the drawer to open the ventilation port, and when the ventilation port opening/closing member is further pulled in a state where the ventilation port is opened, the drawer may be moved together with the ventilation port opening/closing member.

In one embodiment, the case may have a discharge port formed through a bottom surface of the case such that water collected in the case is discharged out of the case, and may include an opening/closing valve opening the discharge port when an external force is applied and closing the discharge port by being restored to an original location by an elastic force when the external force is removed.

In one embodiment, the refrigerator may further include a guide channel formed in an inner surface of the case to guide water collected in the case to the discharge port.

In one embodiment, the guide channel may include at least two mountain parts protruding toward the inside of the case and at least one valley part disposed between the respective mountain parts and depressed toward the outside of the case.

In one embodiment, the bottom surface of the case may be downwardly inclined toward the discharge port.

In one embodiment, the refrigerator may further include a reinforcing part for reinforcing a strength of the case. Here, the reinforcing part may be coupled to the case at a location adjacent to the opening of the case which the drawer is inserted into and may include a reinforcing member having a strength larger than the case.

In one embodiment, the refrigerator may further include a vacuum pump generating a negative pressure in the case.

BRIEF DESCRIPTION OF THE DRAWINGS

The above and other objects, features and other advantages will be more clearly understood from the following detailed description taken in conjunction with the accompanying drawings, in which:

FIGS. 5A-5B are cross-sectional views taken along line A-A of FIG. 3, of which FIG. 5A shows a ventilation port closed by a withdrawable member, and FIG. 5B shows the ventilation port opened by the withdrawable member;

DETAILED DESCRIPTION OF THE PREFERRED EMBODIMENTS

Figure 1:
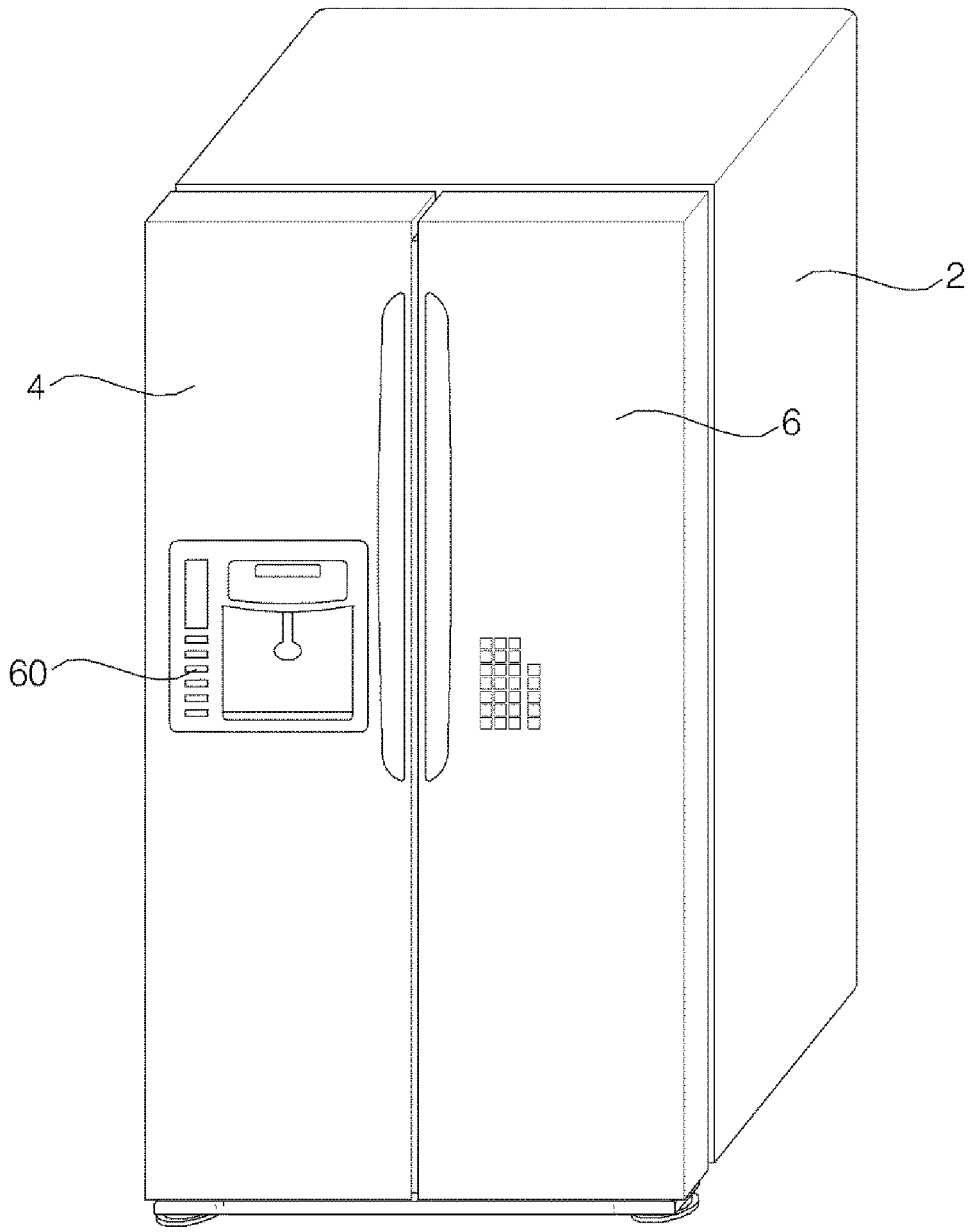
FIG. 1 is a perspective view of a refrigerator according to an embodiment of the present invention.

Advantages and features and a method of achieving the same will be more clearly understood from embodiments described below with reference to the accompanying drawings. However, the present invention is not limited to the following embodiments but may be implemented in various different forms. The embodiments are provided merely to complete disclosure and to fully provide a person having ordinary skill in the art to which the present invention pertains to practice according to the category of the invention. Wherever possible, the same reference numbers may be used throughout the specification to refer to the same or like parts.

Spatially relative terms such as "below," "beneath," "lower," "above," or "upper" may be used herein to describe one element's relationship to another element as illustrated in the drawings. It will be understood that spatially relative terms are intended to encompass different orientations of the elements during use or operation of the elements in addition to the orientation depicted in the drawings. For example, if the elements in one of the drawings are turned over, elements described as "below" or "beneath" other elements would then be oriented "above" the other elements. The exemplary terms "below" or "beneath" can, therefore, encompass both an orientation of above and below. Since the elements may be oriented in another direction, the spatially relative terms may be interpreted in accordance with the orientation of the elements.

The terminology used in this specification is for the purpose of describing particular embodiments only and is not intended to limit the present invention. As used in this specification, the singular forms are intended to include the plural forms as well unless context clearly indicates otherwise. It will be further understood that the terms "comprises" and/or "comprising," when used in this specification, specify the presence of stated elements, steps, and/or operations, but do not preclude the presence or addition of one or more other elements, steps, and/or operations.

Unless otherwise defined, all terms (including technical and scientific terms) used in this specification have the same meaning as commonly understood by a person having ordinary skill in the art to which the present invention pertains. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

In the drawings, the thickness or size of each element may be exaggerated, omitted, or schematically illustrated for convenience of description and clarity. Also, the size or area of each element may not entirely reflect the actual size thereof.

In addition, angles or directions used to describe the structures of embodiments of the present invention are based on those shown in the drawings. Unless there is, in this specification, no definition of a reference point to describe angular positional relations in the structures of embodiments of the present invention, the associated drawings may be referred to.

Figure 2:
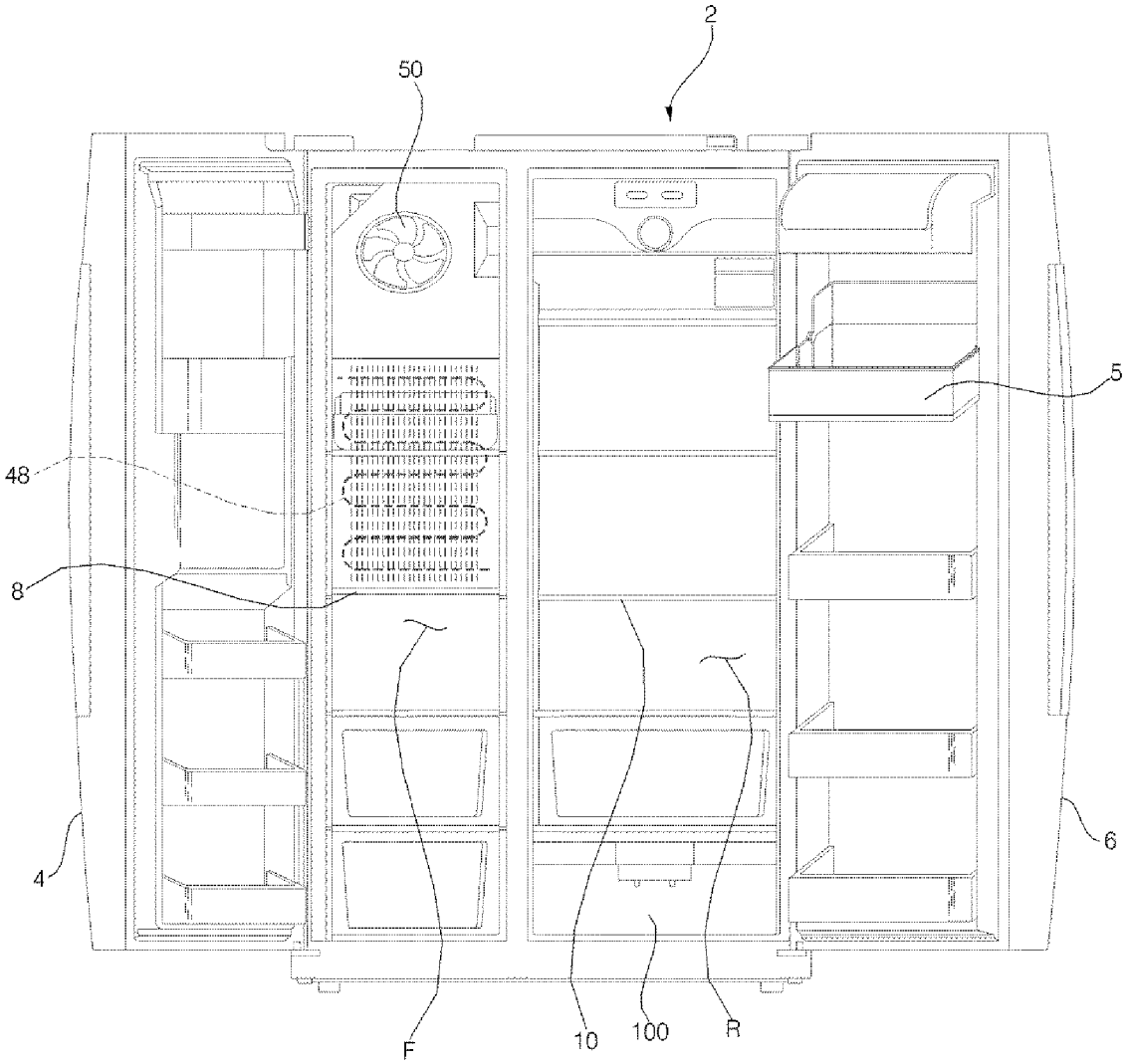
FIG. 2 is a front view illustrating the refrigerator of FIG. 1, a door of which is opened.

FIG. 1 is a perspective view of a refrigerator according to an embodiment of the present invention. FIG. 2 is a front view illustrating the refrigerator of FIG. 1, doors which are opened.

Referring to FIGS. 1 and 2, a refrigerator according to an embodiment of the present invention may include a main body 2 providing a storage compartment divided into a freezer compartment F and a refrigeration compartment R and doors 4 and 6 for opening and closing the freezer compartment F and the refrigeration compartment R.

A cooling device 48 may supply chill into the storage compartments F and R. In the cooling device 48, refrigerant may circulate along a refrigerant pipe. The cooling device 48 may provide a circulation cycle of compression, expansion, evaporation, and condensation of refrigerant. During the evaporation of refrigerant among the circulation cycle, ambient air may be cooled. The cooling device 48 may include a compressor, a condenser, an expander, and an evaporator. In one embodiment, the cooling device 48 may include a thermoelectric module.

The evaporator of the cooling device 48 may contact the outer wall of the storage compartments F and R to directly cool the storage compartments F and R. The cooling device 48 may include a fan 50 that forcibly convects cold air into the storage compartments F and R. In this embodiment, the fan 50 may be provided in the freezer compartment F, but the present invention is not limited thereto.

A plurality of racks 8 and 10 on which stored goods such as food materials and side dishes may be disposed in the main body 2 to divide the inside of the storage compartments F and R.

A pair of doors 4 and 6 may be pivotably disposed on the main body 2 to open and close the freezer compartment F and the refrigeration compartment R, respectively. A basket 5 may be provided at the rear side of the doors 4 and 6 facing the storage compartments F and R to allow stored goods to be placed therein. The basket 5 may also be provided at the freezer compartment door 4 to receive frozen goods such as frozen desserts, or may also be provided at the refrigeration compartment door 6 to receive drinks such as milk, juice, and liquor.

A control panel 60 including a display unit for displaying the operation state of the refrigerator and an input unit for receiving various control commands from a user may be disposed in the door 4 and/or 6.

An airtight container 100 may be provided in the main body to store goods that particularly require moisturization for maintenance of freshness. The airtight container 100 may have a sealed structure that prevents moisture generated from goods stored therein from leaking to the outside. For sufficient airtightness, the inside of the airtight container 100 may be maintained at a negative pressure state or low pressure state. In order to maintain the inside of the airtight container 100 at a weak vacuum state or low pressure state, a vacuum pump (see 190 of FIG. 3) may be further provided to forcibly discharge air out of the airtight container 100. Generally, since vegetables and fruits in which transpiration occurs through the stomata during a longtime storage are stored in the airtight container 100, the airtight container 100 may also be called a vegetable container.

Figure 3:
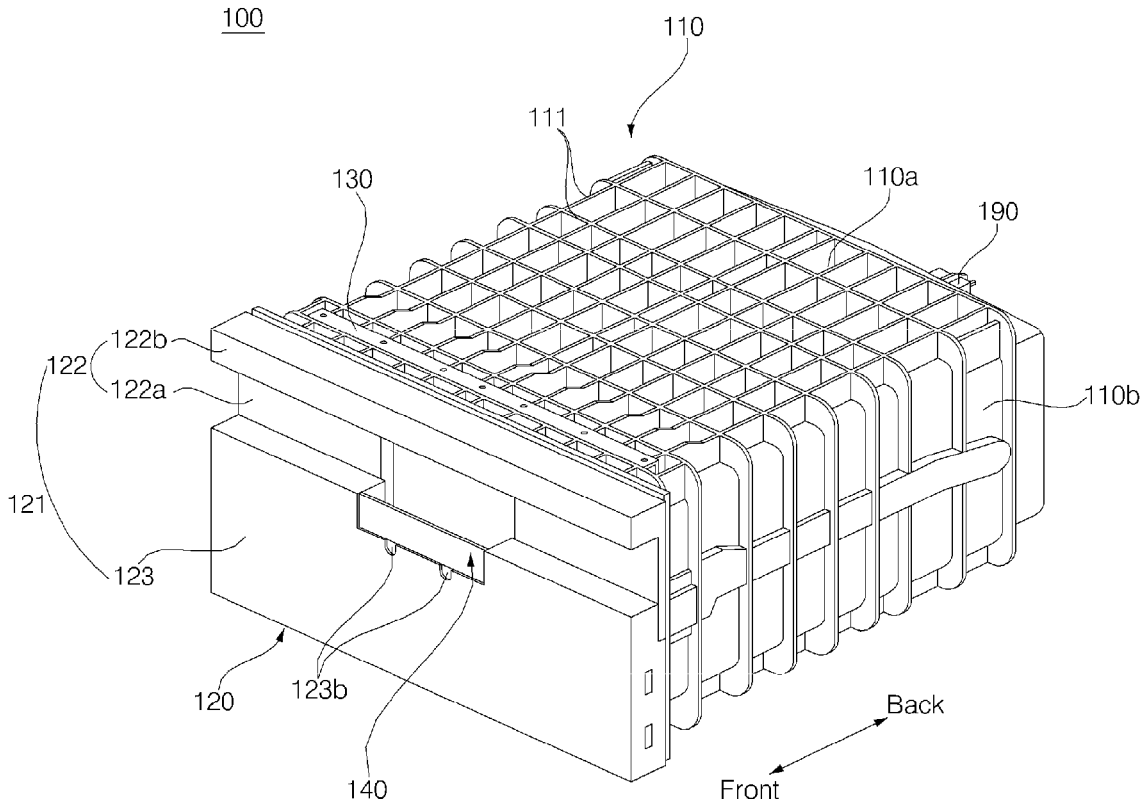
FIG. 3 is a perspective view illustrating an airtight container of FIG. 1.
Figure 4:
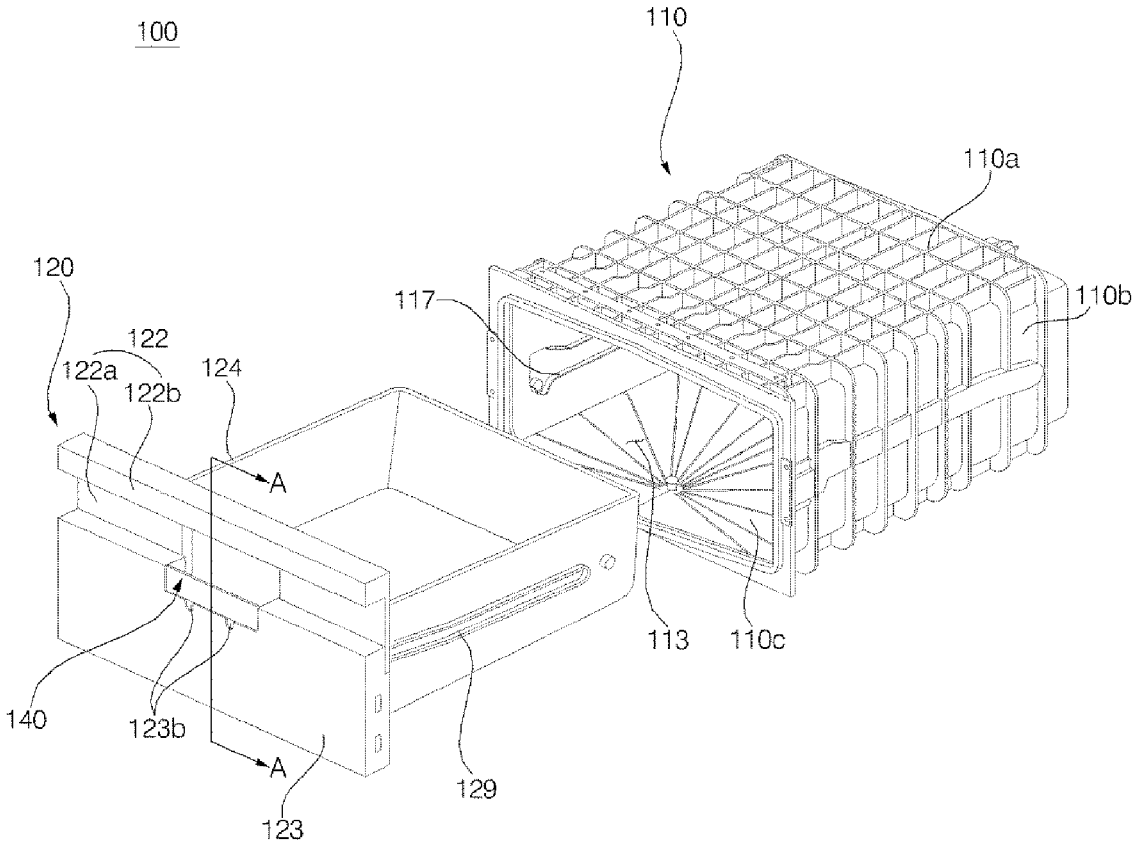
FIG. 4 is a perspective view illustrating the airtight container of FIG. 3, which is opened.
Figure 5:
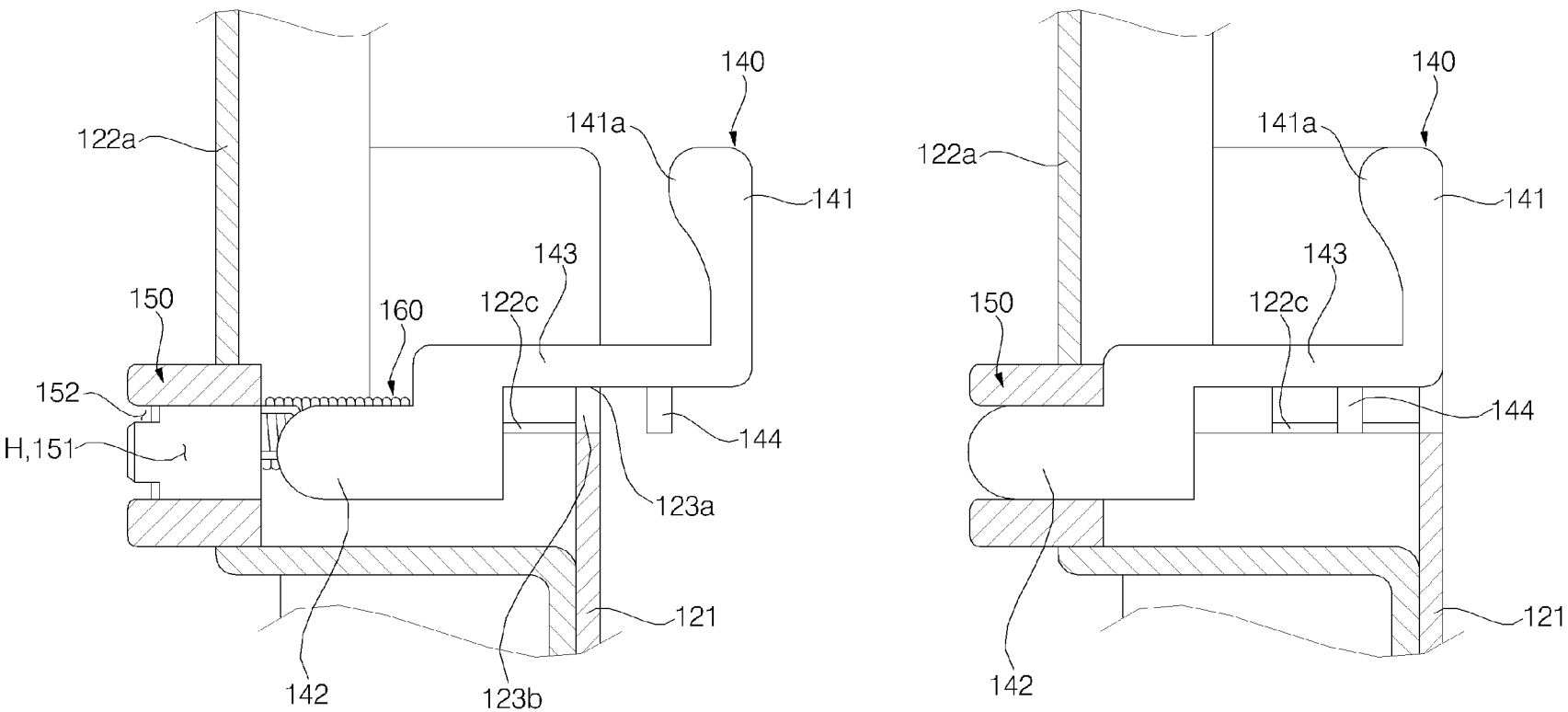

FIG. 3 is a perspective view illustrating an airtight container of FIG. 1. FIG. 4 is a perspective view illustrating the airtight container of FIG. 3, which is opened. FIGS. 5A-5B are cross-sectional views taken along line A-A of FIG. 3, of which 5A shows a ventilation port closed by a withdrawable member, and 5B shows the ventilation port opened by the withdrawable member.

The case 110 may have a storage space formed therein, which is maintained at a negative pressure state. Here, the negative pressure state may refer to a lower atmospheric pressure state than an external atmosphere. As described above, the vacuum pump 190 may be further provided to forcibly discharge air out of the storage space of the case 110. A lower air pressure of the storage space may be advantageous for the airtightness of the airtight container 100, but it is difficult to allow the storage space to become a complete vacuum state. Also, there is a limitation in that the drop of the air pressure can cause the transpiration through the stomata of the vegetables to be activated. Structurally, since the stiffness of the case 110 may also have to be sufficiently secured to endure the drop of the air pressure, it is desirable to maintain the storage space at a weak vacuum state.

More specifically, the case 110 may have an opening 113 formed at the front side thereof. The drawer 120 may be inserted into the case 110 through the opening 113. The case 110 may have a box shape with an opening formed at the front side thereof. The case 110 may include a case rear surface (not shown), a case top surface 110*a* and a case bottom surface 110*c* extending from the case rear surface and facing the case top surface 110*a* in a vertical direction, and a pair of case side surfaces 110*b* facing each other in a horizontal direction.

On the other hand, although not shown, the vacuum pump 190 may also be connected to the case 110 through a connection pipe. In this case, air may be discharged through the connection pipe during the operation of the vacuum pump 190.

For the reinforcement of stiffness, the case 110 may have a reinforcing rib 111 protruding from at least one of the case top surface 110*a*, the case bottom surface 110*c*, and the case side surface 110*b*. The reinforcing rib 111 may be formed to have a lattice structure, and may be formed integrally with the case 110 through injection molding of synthetic resins.

The reinforcing member 130 may add a stiffness to prevent the case from being deformed by a negative pressure of the inside of the case 110. The reinforcing member 130 may be formed of a material, e.g., a metallic material having a stiffness larger than the case 110, and may be coupled to the case 110 along the circumference of the case 110. In this embodiment, the reinforcing member 130 may be laterally extended to be coupled to the case top surface 110*a*, but the present invention is not limited thereto. For example, the reinforcing member 130 may also be provided on the side surface 110*b* or the bottom surface 110*c*.

The drawer 120 may receive stored goods, and may open and close the storage space of the case 110. The drawer 120 may be straightly-movably supported by the case 110. Since the storage space is maintained at a weak vacuum state, when the drawer 120 closes the case 110, the drawer may be adhered closely to the case 110 due to the negative pressure. Accordingly, the airtightness of the storage space may be maintained.

A fixing rail 117 may be disposed on the inner side of the case 110 to support the movement of the drawer 120. A movement guide 129 may be disposed on the drawer 120 to be supported by the fixing rail 117.

The drawer 120 may include a receiving part 124 forming a receiving space and an airtight container door 121 disposed at the front side of the receiving part 124. The receiving part 124 may have a container shape with the upper side thereof opened, and may hold stored goods therein. The airtight container door 121 may include a protrusion bar 122*b* protruding forward such that a user can grip the protrusion bar 122*b*.

More specifically, the airtight container door 121 may include a door frame 122 and a door panel 123 coupled to the front surface of the door frame 122. The door frame 122 may include a cover part 122*a* having a rear surface covering the opening 113 and a front surface on which the door panel 123 is mounted. A sealer (not shown) may be provided on an area of the rear surface of the cover part 122*a* facing the circumference of the opening 113 of the case 110 to improve airtightness of the storage space by adhering closely to the circumference of the opening 113 when the airtight container door 121 is closed. Since the sealer is formed of a flexible material which can be flexibly deformed like silicone or rubber, the sealer may be deformed according to the drop of the air pressure of the storage space.

The ventilation port H may be formed in the door frame 122, particularly, cover part 122*a*, and may be covered by the door panel 122 so as to be invisible from the outside. The protrusion bar 122*b* may forwardly protrude from the upper end of the cover part 122*a*.

The ventilation port opening/closing member 140 may ventilate the storage space such that the weak vacuum state inside the storage space of the case 110 can be released, and may straightly move in the same direction as the drawer 120. The ventilation port H may be opened/closed according to the movement of the ventilation port opening/closing member 140.

A ventilation port sealer 150 may be inserted into the ventilation port H. The ventilation port sealer 150 may be formed of a flexible (deformable) material, and may have a tubular shape and a slit 151.

Even though the ventilation port sealer 150 is inserted into the ventilation port H, ventilation may be still performed through the slit 151. Accordingly, the meaning of opening or closing the ventilation port H should be construed as opening or closing the slit 151 of the ventilation port sealer 150 when the ventilation port sealer 150 is installed. The ventilation port sealer 150 may be formed of silicone or synthetic or natural rubber.

The ventilation port sealer 150 may have a plurality of portions cut at one end thereof opened toward the storage space. For the improvement of airtightness, the inner diameter of the ventilation port sealer 150 may be slightly smaller than the inner diameter of the sealing protrusion 142. In this case, when there is no cut portion 152 at one end of the ventilation port sealer 150, the ventilation port sealer 150 may be torn by a shearing force. Accordingly, in order to overcome this limitation, a pre-cut portion 152 may be formed on one end of the ventilation port sealer 150 on which a stress is concentrated, thereby allowing both sides of the pre-cut portion 152 to naturally spread out when the sealing protrusion 142 is inserted into the ventilation port sealer 150.

The ventilation port opening/closing member 140 may be movably supported by the drawer 120. In this case, the ventilation port opening/closing member 140 may be supported by any one of the door frame 122 or the door panel 123. However, in a structure in which the door panel 123 is formed of a thin plate, it may be difficult to maintain a steady contact between the door panel 123 and the ventilation port opening/closing member 140 on the movement path of the ventilation port opening/closing member 140 only with the door panel 123. Accordingly, it may be desirable that the ventilation port opening/closing member 140 is supported movably along a guide surface of the door frame 122. In a state where the ventilation port H is opened, since a deflection may occur at the front end corresponding to a distance by which the ventilation port opening/closing member 140 is pulled, support may also be needed at the upper end 123*a* of the door panel 123.

The ventilation port opening/closing member 140 may include the sealing protrusion 142 that is inserted into the ventilation port H, 151 for the sealing of the storage space. The sealing protrusion 142 may be inserted into the ventilation port H, 151 to maintain airtightness of the storage space of the case 110. Also, the sealing protrusion 142 may be withdrawn from the ventilation port H, 151 according to the movement of the ventilation port opening/closing member 140 to release the airtight state of the storage space.

Also, the ventilation port opening/closing member 140 may include a grip part 141 vertically extending from a location laterally spaced from the sealing protrusion 142. The sealing protrusion 142 may be connected to the grip part 141 through a connection part 143 extending in a lateral direction.

A support protrusion 144 may downwardly protrude from the connection part 143. The support protrusion 144 may be moved along and supported by a guide groove 122*c* formed in the door frame 122 within a rear region of the door panel 123. A support protrusion withdrawal hole 123*b* may be formed in the door panel 123 such that the support protrusion 144 can enter into the front side of the door panel 123 when the ventilation port opening/closing member 140 is pulled for the opening of the ventilation port H.

The grip part 141 may have a stopping protrusion 141*a* formed on the rear portion thereof. The stopping protrusion 141*a* may have a curved shape at a contact portion to allow a finger of a user to grip thereof. Since the finger of a user contacts the curved surface of the stopping protrusion 141*a*, the grip feeling may be improved, and the grip part may be operated with a smaller force due to an increase of the contact area with the finger.

The elastic member 160 may elastically support the ventilation port opening/closing member 140. The elastic member 160 may be elastically deformed when the ventilation port opening/closing member 140 moves and thus, the sealing protrusion is withdrawn from the ventilation port H. When an external force applied to the ventilation port opening/closing member 140 is removed, the elastic member 160 may restore the ventilation port opening/closing member 140 to the original location by its own restoring force. Accordingly, when a user releases his/her grip after pulling the ventilation port opening/closing member 140, the ventilation port opening/closing member 140 may be automatically restored to the original location, and the ventilation port H may be sealed by the sealing protrusion 142. In this embodiment, the elastic member is exemplified as a spring, but the present invention is not limited thereto. For example, anything else that can restore the ventilation port opening/closing member 140 to the original location due to the restoring force accumulated upon its own deformation can be used.

On the other hand, the process of withdrawing the drawer 120 may include the opening of the ventilation port H, 151 and then the movement of the drawer 120. In this process, since the movement of the ventilation port opening/closing member 140 and the movement of the drawer 120 are in the same direction, the release of the weak vacuum and the withdrawal of the drawer 120 can be achieved through a simple operation, which may be a single operation, of pulling the ventilation port opening/closing member 140 by a user.

The ventilation port opening/closing member 140 and the drawer 120 may be connected to each other by the elastic member 160. When the ventilation port opening/closing member 140 is pulled, the ventilation port H, 151 may be opened together with the deformation of the elastic member 160. When the deformation of the elastic member 160 reaches a certain point, the drawer 120 may move together with the ventilation port opening/closing member 140. When a force for pulling the ventilation port opening/closing member 140 is removed after the opening of the drawer 120, the ventilation port opening/closing member 140 may be restored to the original location by a restoring force of the elastic member 160 in a state where the drawer 120 is withdrawn, and the ventilation port H may be closed again.

Figure 6:
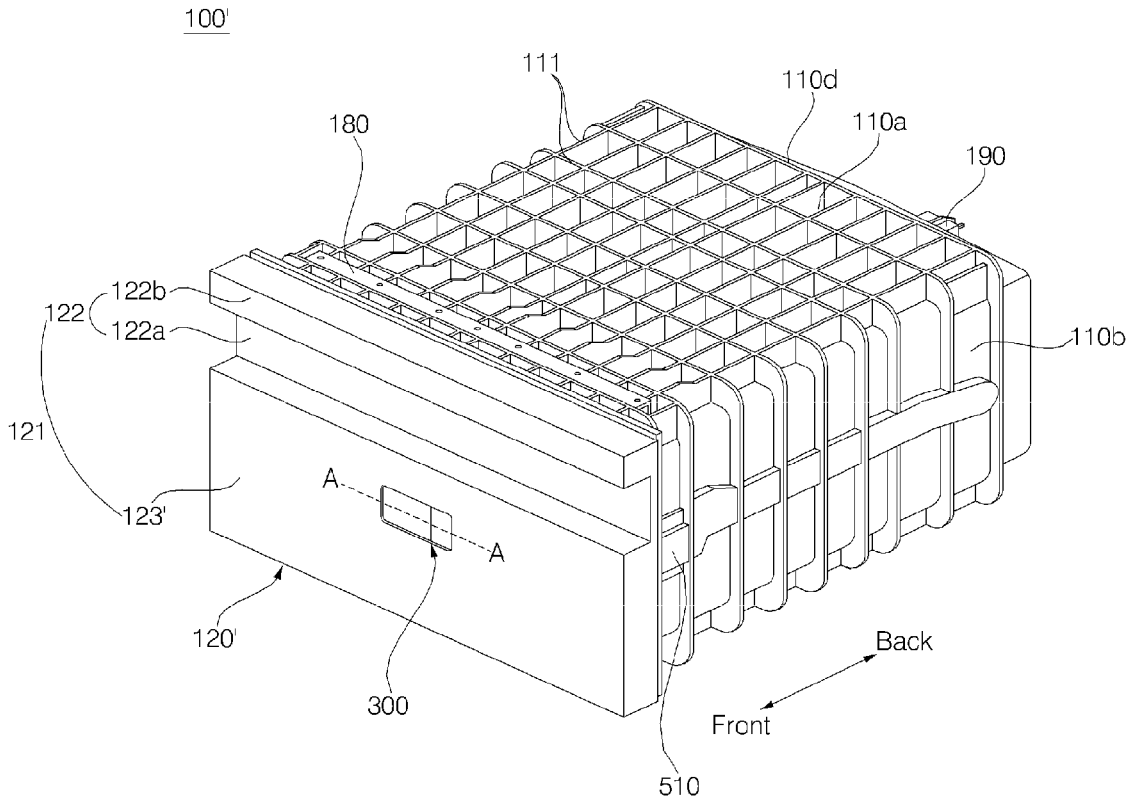
FIG. 6 is a perspective view illustrating an airtight container according to another embodiment of the present invention.
Figure 7:
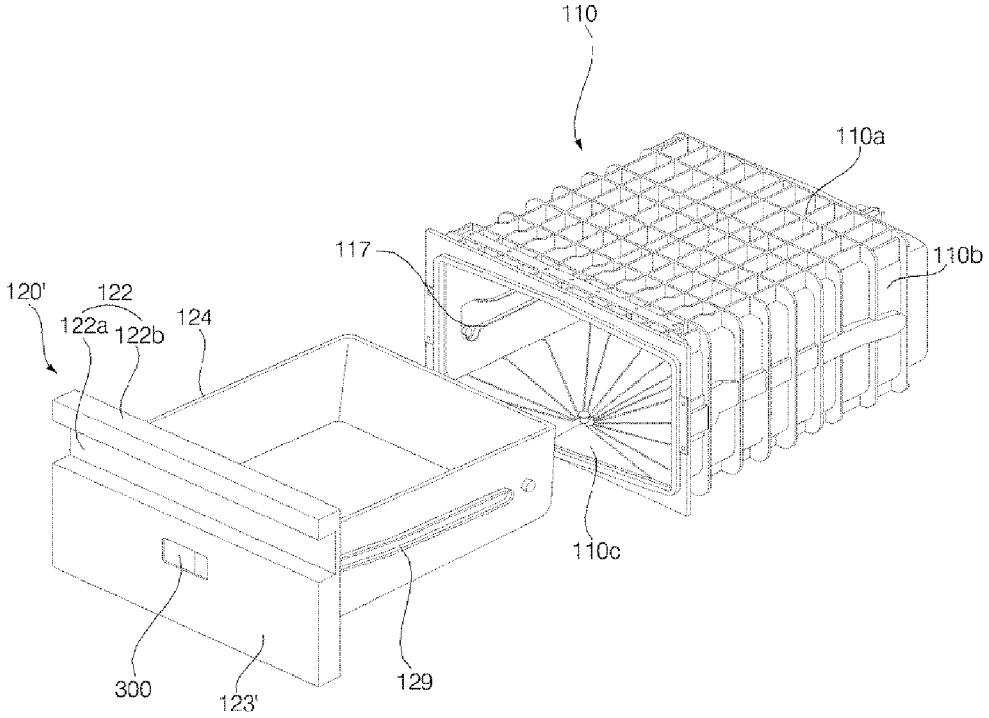
FIG. 7 is a perspective view illustrating the airtight container of FIG. 6, which is opened.
Figure 8:
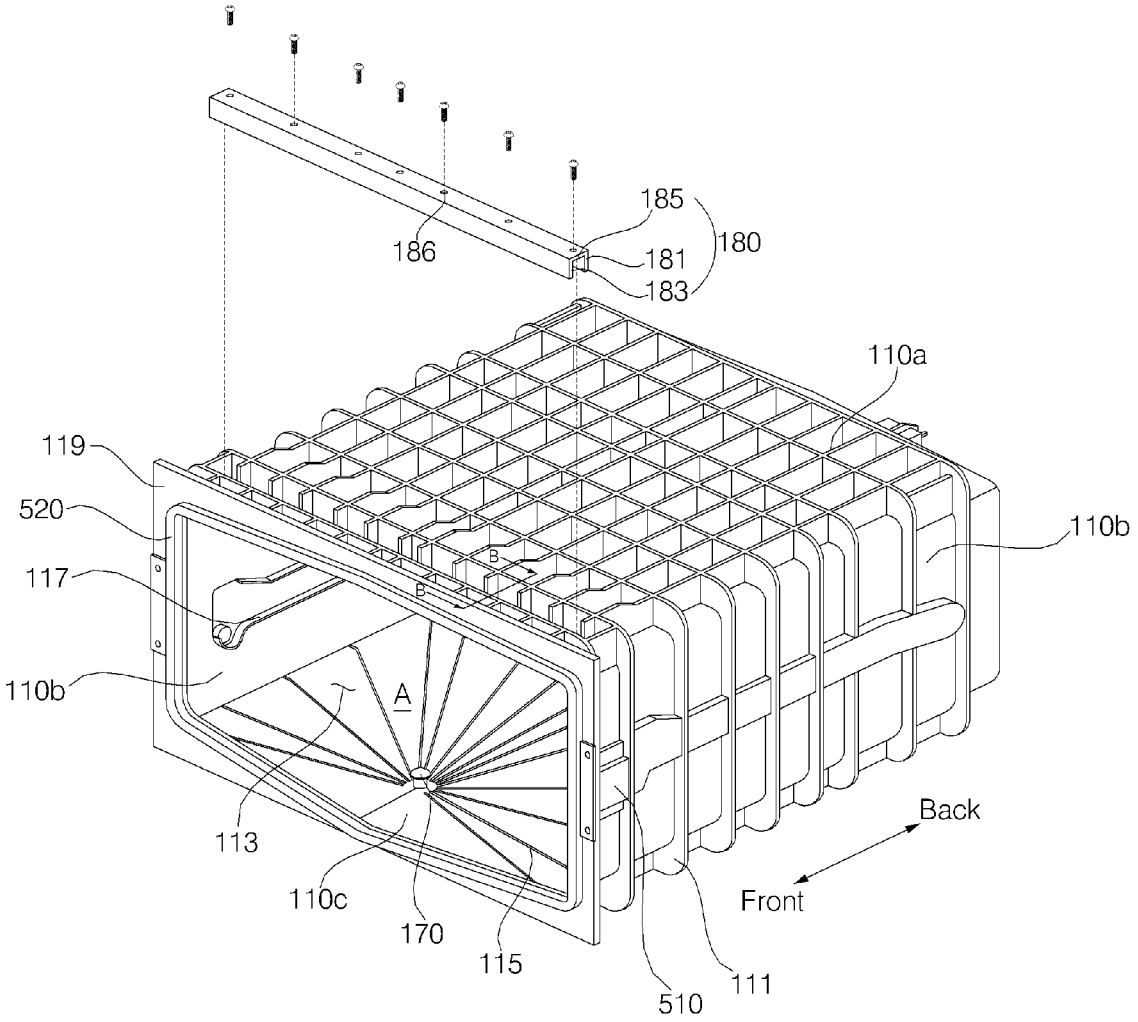
FIG. 8 is a perspective view illustrating a case according to an embodiment of the present invention.
Figure 9:
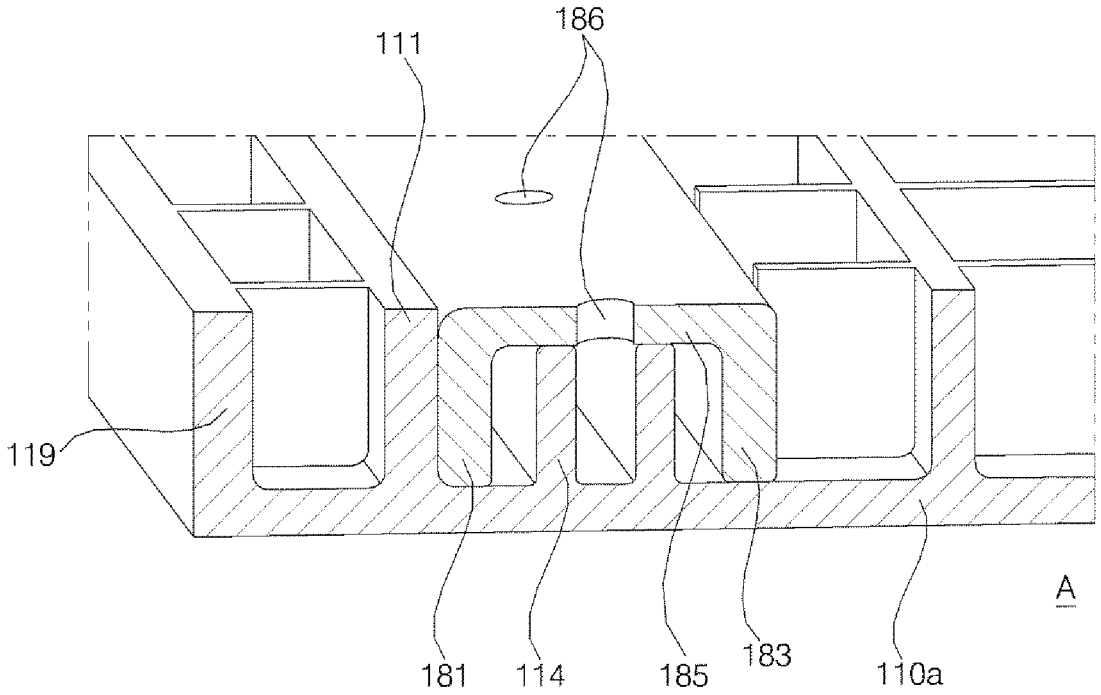
FIG. 9 is a cross-sectional view illustrating the case of FIG. 8 in which a reinforcing member is coupled to the case.
Figure 10:
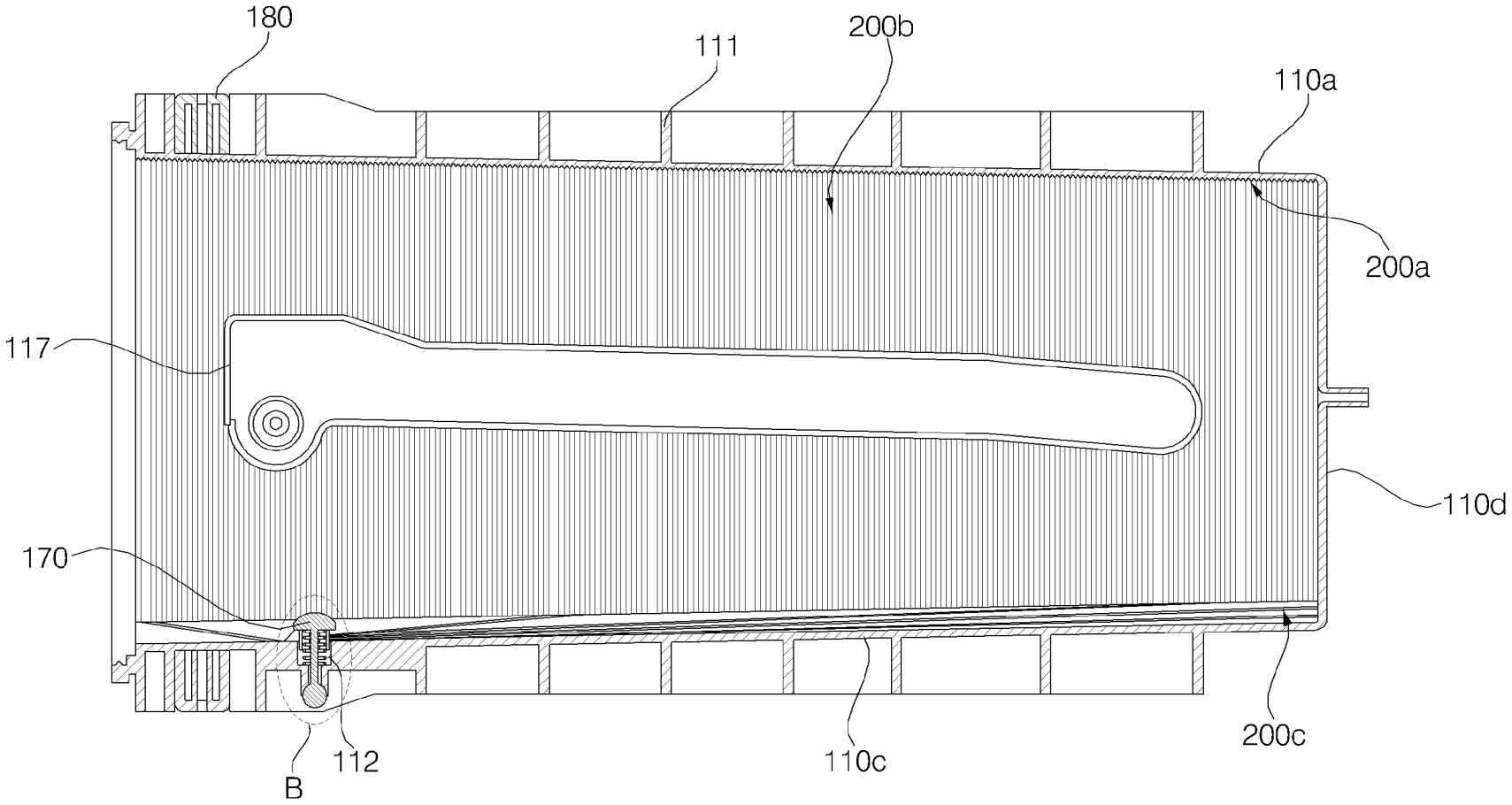
FIG. 10 is a side cross-sectional view illustrating the case of FIG. 8.
Figure 11:
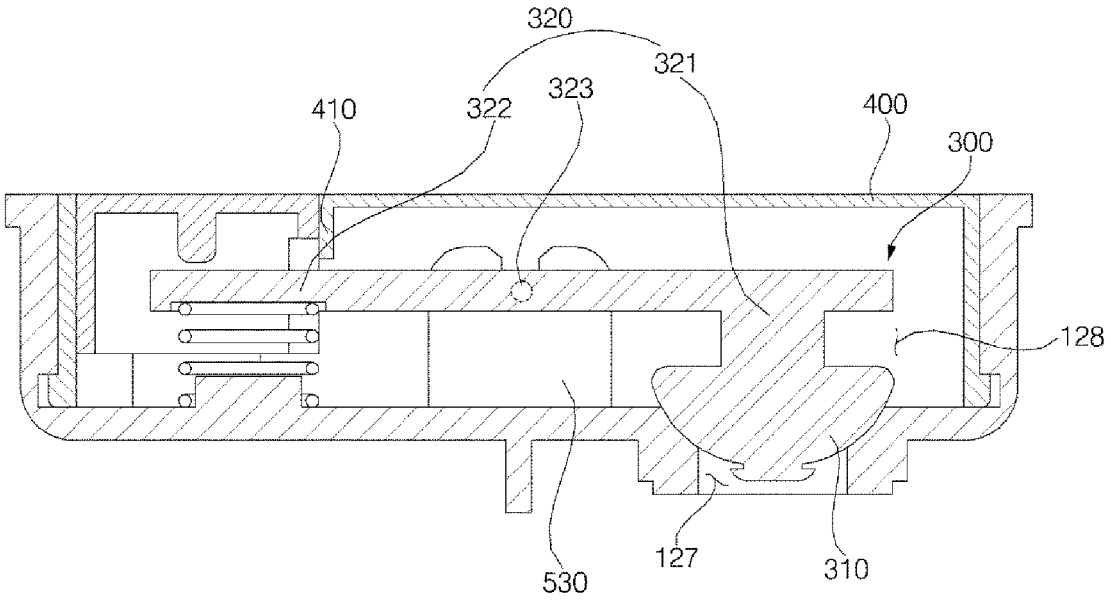
FIG. 11 is a cross-sectional view taken along line A-A of FIG. 6.
Figure 12:
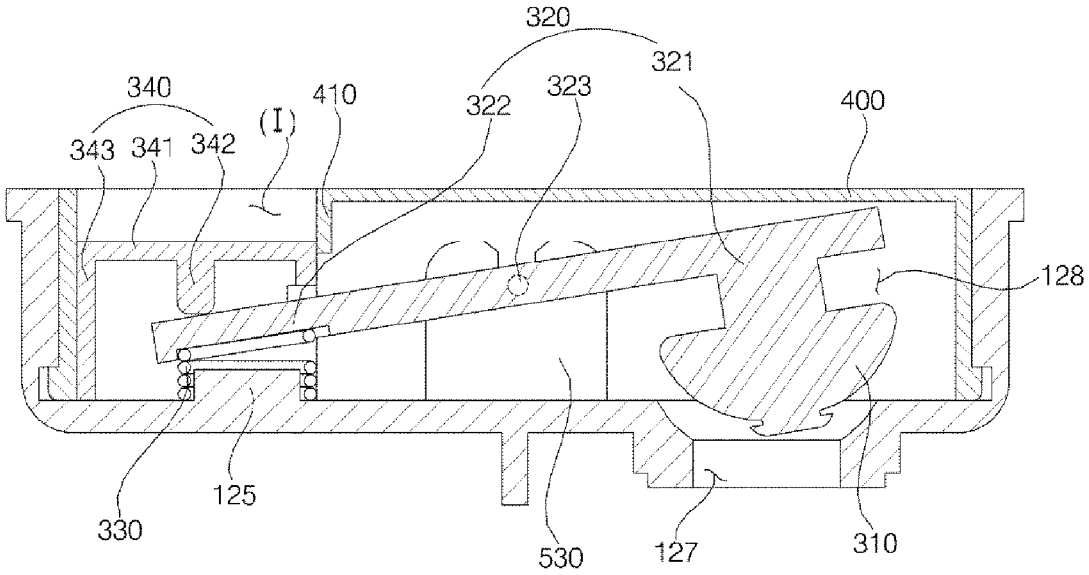
FIG. 12 is a cross-sectional view illustrating a sealing maintaining apparatus of FIG. 11, which releases sealing.
Figure 13:
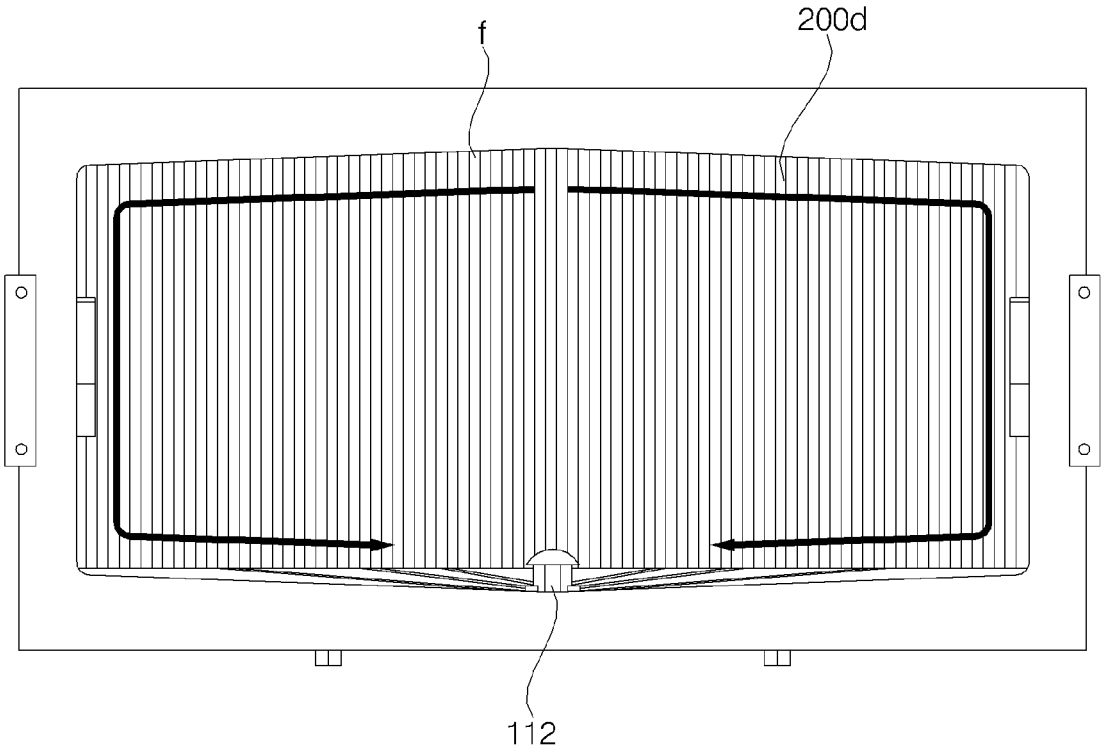
FIG. 13 is a front view illustrating the case of FIG. 8.
Figure 14:
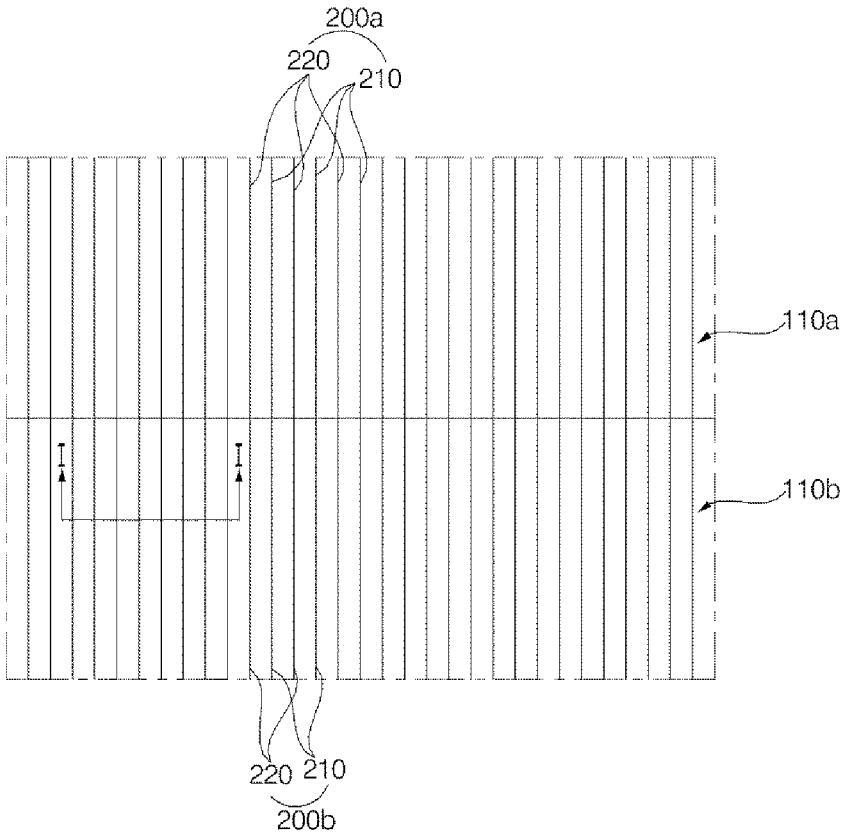
FIG. 14 is a plan view illustrating the case of FIG. 8.
Figure 15:
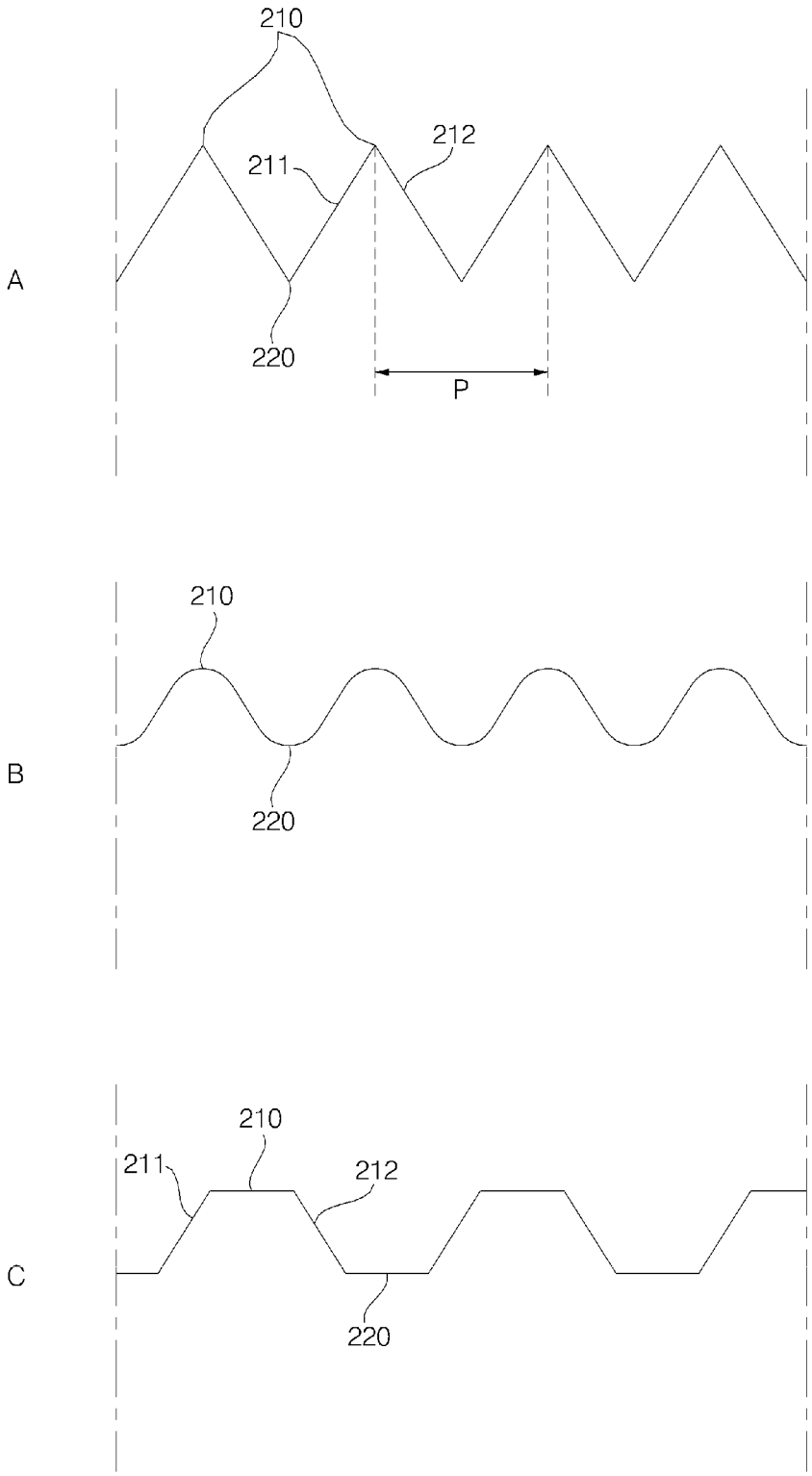
FIG. 15A is a cross-sectional view taken along line I-I of FIG. 14, and FIGS. 15B and 15C are cross-sectional views illustrating a guide channel according to another embodiment of the present invention.

FIG. 6 is a perspective view illustrating an airtight container according to another embodiment of the present invention. FIG. 7 is a perspective view illustrating the airtight container of FIG. 6, which is opened. FIG. 8 is a perspective view illustrating a case according to an embodiment of the present invention. FIG. 9 is a cross-sectional view taken along line B-B of FIG. 8 and a reinforcing member that are coupled to each other. FIG. 10 is a side cross-sectional view illustrating the case of FIG. 8. FIG. 11 is a cross-sectional view taken along line A-A of FIG. 6. FIG. 12 is a cross-sectional view illustrating a sealing maintaining apparatus of FIG. 11, which releases sealing. FIG. 13 is a front view illustrating the case of FIG. 8. FIG. 14 is a plan view illustrating the case of FIG. 8. FIG. 15A is a cross-sectional view taken along line I-I of FIG. 14, and FIGS. 15B and 15C are cross-sectional views illustrating a guide channel according to another embodiment of the present invention.

Referring to FIGS. 1, 6 to 10, and 13, an airtight container 100' according to another embodiment of the present invention may include a case 110, a drawer 120', a discharge port 112, an opening and closing valve 112, and guide channels 200*a* to 200*d*.

The case 110 defines the external appearance of the airtight container or vegetable container 100'. The case 110 is mounted in the storage compartments F and/or R of the main body 2 of the refrigerator. In addition, the case 110 is configured to have a double structure including an inner case and an outer case. The outer case may be fixed in the storage compartments F and R and the inner case may be mounted in the outer case such that the inner case can be withdrawn from the outer case. The case 110 has an opening 113 formed at the front thereof. In the case 110 is defined a receiving space A (see FIG. 8) to store objects.

For example, the case 110 may be formed in the shape of a rectangular parallelepiped having the receiving space A defined therein. More specifically, only the front (opening 113) of the case 110, through which the drawer 120' is inserted or withdrawn, may be opened and the other five faces of the case 110 may be closed. The opening 113 is formed at the front of the case 110 and a rear surface 110*d* is disposed at the rear of the case 110. A top surface 110*a* and a bottom surface 110*c* may be disposed at the top and bottom of the case 110 and lateral surfaces 110*b* may be disposed at opposite sides of the case 110. The top surface 110*a* and the bottom surface 110*c* of the case 110 may have larger area than the lateral surfaces 110*b* of the case 110.

A vacuum pump 190 to generate negative pressure in the case 110 may be mounted at one side of the case 110.

In addition, although not shown, the vacuum pump 190 may be connected to the case 110 via a connection pipe. When the drawer 120' is inserted into the case 110, the vacuum pump 190 may discharge air from the case 110 to decompress the case 110.

At the edge of the opening 113 may be further formed a flange 119 extending outside the receiving space A. That is, the flange 119 may be formed at the front of the case 110 such that the flange 119 extends outward.

The flange 119 may be disposed perpendicularly to the lateral surfaces 110*b* and the top and bottom surfaces 110*a* and 110*c* of the case 110. The flange 119 being disposed perpendicularly to the lateral surfaces 110*b* and the top and bottom surfaces 110*a* and 110*c* of the case 110 may mean that the flange 119 extends in the vertical direction and in the horizontal direction of the case 110. In addition, the term "perpendicularly" does not mean "completely perpendicularly" in mathematical terms but means "perpendicularly while having an error" in engineering terms.

The flange 119 may be disposed perpendicularly to the top surface 110*a* and the bottom surface 110*c* of the case 110 to prevent the edge of the opening 113 from drooping due to negative pressure generated in the case 110. Specifically, the flange 119 may be formed in the vertical direction of the case 110 to function as a bending stress support to resist bending stress generated at the edge of the opening 113.

In addition, the flange 119 provides a region contacting the drawer 120' when the drawer 120' hermetically seals the case 110. Particularly, in a case in which the interior of the case 110 is maintained almost in a vacuum state, it is necessary for the interior of the case 110 to be completely isolated from the outside. Since the flange 119 provides a space which the drawer 120' contacts, the flange 119 improves hermetical sealing performance of the airtight container 100'. In addition, in a case in which a hermetical sealing member 520 is used at a contact area between the drawer 120 and the case 110, the flange 119 may provide a space which the hermetical sealing member 520 contacts.

At least one surface of the edge of the opening 113 may be configured to have an arch structure in which the middle portion of the surface of the edge of the opening 113 protrudes outwardly from the receiving space A.

For example, as shown in FIG. 8, the edge of the opening 113 has a rectangular shape including the top surface 110*a*, the bottom surface 110*c*, and the lateral surfaces 110*b* of the case 110. The top surface 110*a* and the bottom surface 110*c* of the case 110 are generally longer than the lateral surfaces 110*b* of the case 110. As a result, the top surface 110*a* and the bottom surface 110*c* of the case 110 may be greatly deformed due to bending stress generated by the difference in pressure between the inside and the outside of the case 110. In a case in which one surface (for example, the front end of the top surface 110*a* of the case 110) of the edge of the opening 113 has an arch structure in which in which the middle portion of the surface of the edge of the opening 113 protrudes outwardly from the receiving space A, therefore, it is possible to effectively resist bending stress applied in the internal direction of the case 110. That is, in a case in which the edge of the opening 113 is designed to have an arch structure, it is possible to prevent the circumference of the opening 113 of the case 110 from being bent inside the case 110.

The case 110 may further include a reinforcing rib 111 to increase strength of the case 110.

The reinforcing rib 111 is a member formed in the direction in which the case 110 is deformed. The reinforcing rib 111 may be integrally formed with the case 110 by injection molding.

For example, the reinforcing rib 111 may be formed at the outer surface of the case 110 to secure the receiving space A in the case 110. In addition, a plurality of reinforcing ribs 111 may be formed in a first direction and a plurality of reinforcing ribs 111 may be further formed in a direction intersecting the first direction.

In the inner surface of the case 110, there may be formed fixed rails 117 to guide the drawer 120' such that the drawer 120 can be inserted into and withdrawn from the case 110 in a drawer fashion. For example, the fixed rails 117 may be formed at the inner lateral surfaces of the case 1110 such that the fixed rails 117 extend from the front to the rear.

The drawer 120' hermetically seals the interior of the case 110. The drawer 120 defines the external appearance of the vegetable container 100' together with the case 110.

For example, the drawer 120' may include a receiving part 124 defining a receiving space to receive objects to be stored and an airtight container door 121 disposed at the front of the receiving part 124.

The receiving part 124 is inserted into and withdrawn from the case 110 in a drawer fashion. For example, moving guides 129 corresponding to the fixed rails 117 of the case 110 are formed at the outer surface of the receiving part 124 such that the receiving part 124 can move forward from the case 110 and backward into the case 110 along the fixed rails 117.

For example, the receiving part 124 may have a hexahedral shape opened at the top and the front thereof.

The airtight container door 121 may be disposed at the front of the receiving part 124. The airtight container door 121 may be formed to have a larger size than the receiving part 124. Consequently, the edge of the airtight container door 121 contacts the edge of the opening 113 to hermetically seal the case 110.

The airtight container door 121 may be formed approximately in the shape of a rectangle (rectangular parallelepiped). More specifically, the airtight container door 121 may have a size and a shape corresponding to the size and the shape of the flange 119 of the opening 113. That is, the airtight container door 121 may be formed so as to contact the flange 119 of the case 110.

The airtight container door 121 may include a door frame 122 and a door panel 123' coupled to the front surface of the door frame 122. The door frame 122 may include a cover part 122*a* having a rear surface covering the opening 113 and a front surface on which the door panel 123' is mounted. A sealer (not shown) may be provided on an area of the rear surface of the cover part 122*a* facing the circumference of the opening 113 of the case 110 to improve airtightness of the storage space by adhering closely to the circumference of the opening 113 when the airtight container door 121 is closed. Since the sealer is formed of a flexible material which can be flexibly deformed like silicone or rubber, the sealer may be deformed according to the drop of the air pressure of the storage space.

In a case in which the interior of the case 110 is hermetically sealed by the drawer 120', the difference in pressure between the inside and the outside of the case 110 is generated. That is, when the interior of the case 110 is hermetically sealed by the drawer 120', the interior of the case 110 is decompressed by the vacuum pump 190 with the result that the pressure inside the case 110 becomes lower than the pressure outside the case 110.

The hermetical sealing member 520 may be provided at a contact region between the airtight container door 121 of the drawer 120' and the edge of the opening 113 to isolate the inside of the case 110 from the outside of the case 110. For example, the hermetical sealing member 520 may be made of a rubber material.

The hermetical sealing member 520 may be formed along the edge (or the flange 119) of the opening 113 in a closed loop shape.

Between the case 110 and the drawer 120' there may be provided a hermetical sealing retention device 510 to retain an isolated state of the inside of the case 110 from the outside of the case 110.

For example, the hermetical sealing retention device 510 may include a catching part coupled to one selected from between the drawer 120' and the case 110 and a fastening part coupled to the other selected from between the drawer 120' and the case 110 such that the fastening part can be fastened to the catching part. However, the present invention is not limited thereto. The hermetical sealing retention device 510 may have various structures.

Referring to FIGS. 8, 10, and 13, the discharge port 112 is formed at the bottom surface 110*c* of the case 110 such that water formed in the case 110 is collected at the discharge port 112. Specifically, the discharge port 112 is formed through the bottom surface 110*c* of the case 110 such that water formed in the case 110 is discharged out of the case 110 through the discharge port 112.

The discharge port 112 is positioned lower than the bottom surface 110*c* of the case 110 such that water formed in the case 110 can be collected at the discharge port 112 due to gravity. The water in the case 110 may be dew formed as the result of saturation of moisture in the case 110 when the temperature in the case 110 is lowered to a dew point or less.

More specifically, the bottom surface 110*c* of the case 110 may be inclined downward toward the discharge port 112 such that water flowing due to gravity can be effectively guided to the discharge port 112.

A various number of discharge ports 112 may be provided. In a case in which one discharge port 112 is provided, the discharge port 180 may be disposed approximately at the middle portion of the bottom surface 110*c* of the case 110 for advantageous water collection.

In the discharge port 112, there may be provided an opening and closing valve 170 to open and close the discharge port 112 so as to control discharge of water collected at the discharge port 112. The opening and closing valve 170 will hereinafter be described in detail.

Referring to FIGS. 11 and 12, a ventilation port 127 may be further provided to allow air to flow into and out of the drawer 120'. Also, a sealing maintaining apparatus 300 may be further provided in the drawer 120' to open and close the ventilation port 127.

The ventilation port 127 may penetrate the drawer 120' to allow external air to flow into and out of the case 110. When external air flows into the case 110 through the ventilation port 127, the weak vacuum state inside the case 110 may be released.

For example, the ventilation port 127 may be formed in the airtight container door 121 of the drawer 120'.

The sealing maintaining apparatus 300 may be disposed in the drawer 120' to open and close the ventilation port 127 by an external force and an elastic force.

The sealing maintaining apparatus 300 may be disposed to be exposed to the outside of the drawer 120', or may be embedded in the drawer 120'.

Specifically, as shown in FIG. 11, the airtight container door 121 of the drawer 120' may further include a receiving part 128 for receiving the sealing maintaining apparatus 300 and a receiving part cover 400 for covering the receiving part 128.

The receiving part 128 may be formed by having a portion of the airtight container door 121 of the drawer 120' being recessed in the direction of the receiving part. The receiving part 128 may be formed to have a space of a substantially hexahedral shape, and may be located at the center of the airtight container door 121 of the drawer 120'.

The receiving part cover 400 may cover the receiving part 128, and may be disposed so as to expose an operation switch 340. That is, the receiving part cover 400 may cover the sealing maintaining apparatus 300 from the outside and may expose only the operation switch 340 in order to improve the aesthetic feeling of the exterior of the drawer 120'.

For example, the sealing maintaining apparatus 300 may include a sealing part 310, a driving arm 320, a compression spring 330, and an operation switch 340.

The sealing part 310 may seal the ventilation port 127. The sealing part 310 may be formed to have a large contact area with the ventilation port 127 so as to seal the ventilation port 127 by adhering closely to the ventilation port 127.

Specifically, the sealing part 310 may have a semi-spherical shape protruding into the ventilation port 127, and the edge of the ventilation port 127 may have a shape corresponding to the sealing part 310.

The sealing part 310 may be formed of a deformable material having a shape to effectively seal the ventilation port 127 when contacting the ventilation port 127. For example, the sealing part 310 may include rubber or silicone.

The driving arm 320 may be rotatably disposed in the drawer 120' to deliver a driving force caused by an external force to the sealing part 310.

Specifically, in order to provide a space in which the driving arm 320 is rotatable, the driving arm 320 may be rotatably disposed on a supporter 530 upwardly protruding from the airtight container door 121 of the drawer 120'.

For example, the driving arm 320 may include a rotation axis 323 that is rotatably inserted into the supporter 530 at the center thereof. One end 321 of the driving arm 320 may be connected to the sealing part 310, and the other end 322 of the driving arm 320 symmetrically disposed about the rotation axis 323 may be supported by the compression spring 330.

The compression spring 330 may provide the driving arm 320 with an elastic force such that the sealing part 310 seals the ventilation port 127.

In order to fix the location of the compression spring 330, a fixing protrusion 125 may be formed to upwardly protrude from the airtight container door 121 of the drawer 120'. One end of the compression spring 330 may be inserted into the fixing protrusion 125 to be fixed. Also, a hole may be formed in the other end 322 of the driving arm 320 to fix the other end of the compression spring 330.

In other words, the driving arm 320 may be rotatably disposed about the rotation axis 323, and the sealing part 310 may be connected to the lower side of one end 321 of the driving arm 320. Also, the compression spring 330 may be disposed under the other end of the driving arm 320. Accordingly, the driving arm 320 may be rotated by the rotation axis 323 in which an elastic force of the compression spring 330 pivots to a sealing location (see FIG. 11) in which the sealing part 310 seals the ventilation port 127 and an external force overcomes the elastic force to pivot to a release location (see FIG. 12) in which the sealing part 310 opens the ventilation port 127.

Here, the external force may denote all forces that overcome the elastic force by the compression spring 330 and move the other end 322 of the driving arm 320 in a downward direction.

When the other end 322 of the driving arm 320 moves downward, one end 321 of the driving arm 320 symmetrically disposed about the rotation axis 323 may move upward, allowing the sealing part 310 to be spaced from the ventilation port 127.

In this case, when the sealing maintaining apparatus 300 is accommodated in the receiving part 128, the supporter 530 may be formed to protrude from the bottom of the receiving part 128.

The operation switch 340 may be disposed in the drawer 120', and may allow the driving arm 320 to rotate between the sealing location and the release location. That is, when a user applies an external force to the operation switch 340, the operation switch 340 may deliver the external force to the driving arm 320.

Specifically, the operation switch 340 may be disposed over the other end 322 of the driving arm 320, and the compression spring 330 may be disposed under the other end 322 of the driving arm 320. Accordingly, when an external force is applied to the operation switch 340, the external force may exceed the elastic force of the compression spring 330, allowing the other end 322 of the driving arm 320 to move downward and thus, allowing the sealing part 310 to be spaced from the ventilation port 127. On the other hand, when the external force is removed, the operation switch 340 may be restored to the initial location by the elastic force of the compression spring 330. The operation switch 340 and the compression spring 330 may be vertically and symmetrically disposed about the driving arm 320.

The operation switch 340 may be disposed in the airtight container door 121 of the drawer so as to be exposed to the outside, and may be disposed so as to reciprocate in the direction of the movement of the drawer 120.

Specifically, when the receiving part 128 is covered by the receiving part cover 400, a region I may be opened. The operation switch 340 may be disposed in the region I so as to reciprocate in the direction of the movement of the drawer 120.

More specifically, the operation switch 340 may include an operation plate 341 exposed to the outside and disposed on the same plane as or flush with the receiving part cover 400, a pushing part 342 downwardly protruding from the operation plate 341 to push the other end 322 of the driving arm 320, and a guide piece 343 downwardly extending from the edge of the operation plate 341 to be guided by an operation switch guide 410 described below.

The receiving part cover 400 may further include the operation switch guide 410 for guiding the movement of the operation switch 340.

Specifically, the operation switch guide 410 may downwardly extend from the edge of the receiving part cover 400 by a certain length into the region I.

Hereinafter, an operation method of the embodiment will be described with reference to FIGS. 11 and 12.

Referring to FIG. 11, when the drawer 120' seals the case 110, the inside of the case 110 may be in a weak vacuum state generated by the vacuum pump 190. In this case, the operation switch 340 may be located at the initial location by an elastic force of the compression spring 330. In other words, the other end 322 of the driving arm 320 may be upwardly asserted by the elastic force of the compression spring 330, and one end 321 of the driving arm 320 symmetrically disposed about the rotation axis 323 may be downwardly asserted to cause the sealing part 310 to seal the ventilation port 127.

Referring to FIG. 12, in case where the drawer 120' is withdrawn from the case 110, when a user applies an external force to the operation switch 340, the external force may exceed the elastic force of the compression spring 330, allowing the other end 322 of the driving arm 320 to move downward and allowing one end 321 of the driving arm 320 symmetrically disposed about the rotation axis 323 to move upward. Thus, the sealing part 310 may open the ventilation port 127. Accordingly, the weak vacuum state inside the case 110 may be released, and a user can easily open the drawer 120'.

In this embodiment, a user can easily release the weak vacuum state inside the case 110 by asserting force on the operation switch 340 before the drawer 120' is opened.

When the inside of the case 110 is in the weak vacuum state, it may be difficult even for an adult to open the drawer 120' due to a pressure difference between the inside and the outside of the case 110. However, in this embodiment, since the weak vacuum state of the inside of the case 110 can be released by the sealing maintaining apparatus 300, a user can easily open the drawer 120'.

Referring to FIGS. 8 to 10 and 13 to 15C, the guide channels 200*a* to 200*d* are formed at the inner surface of the case 110 to guide water formed in the case 110 to the discharge port 112. In addition, the guide channels 200*a* to 200*d* serve to hide dew formed in the case 110 such that the dew cannot be observed by the naked eye.

The guide channels 200*a* to 200*d* may be formed at least a portion of the inner surface of the case 110. Of course, the guide channels 200*a* to 200*d* may be formed at the entire inner surface of the case 110. The guide channels 200*a* to 200*d* may have various shapes.

The guide channels 200*a* to 200*d* may be formed at the inner surface of the case 110 such that the guide channels 200*a* to 200*d* depress and protrude to guide water toward the discharge port 112.

For example, the guide channels 200*a* to 200*d* may include at least two mountain parts 210 protruding toward the inside of the case 110 and at least one valley part 220 disposed between the respective mountain parts 210, the valley part 220 being depressed toward the outside of the case 110.

The mountain parts 210 are parts extending in one direction in a state in which the mountain parts 210 protrude more than the valley part 220 such that water formed in the case 110 can flow to the valley part 220. The valley part 220 is formed between the respective mountain parts 210 such that the valley part 220 is lower than the mountain parts 210 to provide a water guide channel.

In particular, referring to FIGS. 15A-15C, each of the mountain parts 210 may have any one selected from among a triangular shape, a quadrangular shape, and a semicircular shape as a sectional shape. In a case in which the sectional shape of each of the mountain parts 210 is the triangular shape or the semicircular shape, dew formed on the inner surface of the case 110 easily flows to the valley part 220 such that the dew cannot be observed by the naked eye.

More specifically, each of the mountain parts 210 may be defined by two inclined sides 211 and 212. That is, each of the mountain parts 210 may have a triangular or quadrangular section having two inclined sides 211 and 212.

A pitch P between the respective mountain parts 210 may be 1.5 mm to 2.5 mm. In a case in which the pitch P between the respective mountain parts 210 is greater than 2.5 mm, dew formed on the inner surface of the case 110 cannot easily move to the valley parts 220. On the other hand, in a case in which the pitch P between the respective mountain parts 210 is less than 1.5 mm, each of the valley parts 220 cannot provide a sufficient space to collect dew with the result that the dew may be observed by the naked eye.

In addition, each of the mountain parts 210 may have a height of 1.5 mm to 2.5 mm. In a case in which the height of each of the mountain parts 210 is too large, the strength of the case 110 is lowered. On the other hand, in a case in which the height of each of the mountain parts 210 is too small, each of the valley parts 220 cannot provide a sufficient space to collect dew.

Hereinafter, the guide channels 200*a* to 200*d* formed at the respective surfaces of the case 110 will be described in detail.

Referring to FIGS. 8, 10, 13 and 14, the guide channels 200*a* to 200*d* may include top surface guide channels 200*a*, lateral surface guide channels 200*b*, rear surface guide channels 200*d*, and bottom surface guide channels 200*c*.

The top surface guide channels 200*a* are formed at the inner side of the top surface 110*a* of the case 110. The mountain parts 210 and the valley parts 220 of the top surface guide channels 200*a* may extend toward the lateral surfaces 110*b* of the case 110. In addition, the mountain parts 210 and the valley parts 220 of the top surface guide channels 200*a* may extend from the front to the rear surface 110*d* of the case 110.

The top surface 110*a* of the case 110 may be inclined downward from the middle of the case to the lateral surfaces 110*b* of the case 110 such that water formed on the inner surface of the case 110 is guided to the lateral surfaces 110*b* of the case 110 along the top surface guide channels 200*a* due to gravity. That is, as shown in FIGS. 8 and 13, the top surface 110*a* of the case 110 may be configured to have an arch structure in which the middle portion of top surface 110*a* of the case 110 protrudes upward from the case 110. In a case in which the top surface 110*a* of the case 110 is formed as described above, the strength of the top surface 110*a* of the case 110 is increased and water formed on the top surface 110*a* of the case 110 can be guided to the lateral surfaces 110*b* of the case 110 due to gravity.

The lateral surface guide channels 200*b* are formed at the inner sides of the lateral surfaces 110*b* of the case 110. The mountain parts 210 and the valley parts 220 of the lateral surface guide channels 200*b* may extend from the top surface 110*a* of the case 110 to the bottom surface 110*c* of the case 110 such that water formed on the lateral surfaces 110*b* of the case 110 can flow toward the bottom surface 110*c* of the case 110 due to gravity.

In addition, the valley parts 220 of the top surface guide channels 200*a* may be connected to (communicate with) the valley parts 220 of lateral surface guide channels 200*b* such that water formed on the top surface 110*a* of the case 110 can be effectively guided to the lateral surfaces 110*b* of the case 110.

The rear surface guide channels 200*d* are formed at the inner side of the rear surface 110*d* of the case 110. The mountain parts 210 and the valley parts 220 of the rear surface guide channels 200*d* may extend from the top surface 110*a* of the case 110 to the bottom surface 110*c* of the case 110 such that water formed on the rear surface 110*d* of the case 110 can flow toward the bottom surface 110*c* of the case 110 due to gravity.

The bottom surface guide channels 200*c* are formed at the inner side of the bottom surface 110*c* of the case 110.

The mountain parts 210 and the valley parts 220 of the bottom surface guide channels 200*c* may extend toward the discharge port 112 such that water formed in the case 110 can flow toward the discharge port 112 due to gravity. In addition, the bottom surface guide channels 200*c* may be inclined downward to the discharge port 112 to more effectively collect water.

For example, the bottom surface guide channels 200*c* may extend from the discharge port 112 in a radial manner. Of course, the valley parts 220 of the top surface guide channels 200*a*, the valley parts 220 of the lateral surface guide channels 200*b*, and the valley parts 220 of the bottom surface guide channels 200*c* may be connected to (communicate with) each other to effectively collect water.

As shown in FIG. 13, therefore, water (dew) formed in the case 110 may flow along a water movement channel f and then be collected at the discharge port 112.

A reinforcing part functions to increase the strength of the case 110. For example, referring to FIGS. 8-10, the reinforcing part may be embodied as a reinforcing member 180 coupled to one surface of the case 110. In a case in which the opening 113 is formed at the front of the case 110, when the pressure inside the case 110 is lower than the pressure outside the case 110, the result is that the edge of the opening 113 droops toward the interior of the case 110. The reinforcing member 180 may prevent the edge of the opening 113 from drooping. The edge of the opening 113 includes front tips of the top surface 110*a* of the case 110, the bottom surface 110*c* of the case 110, and the lateral surfaces 110*b* of the case 110.

More specifically, the reinforcing member 180 may be disposed at the largest one of the surfaces of the case 110. That is, in a case in which the case 110 is formed in the shape of a rectangular parallelepiped having the opening 113 formed at the front thereof as shown in FIG. 8, the tips of the largest one (the top surface 110*a* or the bottom surface 110*c* of the case 110) of the surfaces of the case 110 are the most greatly deformed when the difference in pressure between the inside and the outside of the case 110 is formed. In a case in which the reinforcing member 180 is disposed at the largest one of the surfaces of the case 110 while being adjacent to the edge of the opening 113, it is possible to effectively prevent deformation of the opening 113.

The reinforcing member 180 may be disposed at the top surface 110*a* of the case 110. In addition, the reinforcing member 180 may be disposed at the outside of the top surface 110*a* of the case 110 since the receiving space A is reduced in a case in which the reinforcing member 180 is disposed inside the case 110.

The reinforcing member 180 may be disposed adjacent to the opening 113 since the edge of the opening is the most greatly deformed.

The reinforcing member 180 may be disposed in parallel to the edge of the opening 113. The term "parallel" does not mean "parallel" in mathematical terms but means "parallel while having an error" in engineering terms. In addition, the term "parallel" may mean "parallel" between curved lines disposed to correspond to each other while being spaced apart from each other by a fixed distance as well as "parallel" between straight lines. In a case in which the reinforcing member 180 is disposed in parallel to the edge of the opening 113, it is possible to more effectively prevent deformation of the edge of the opening 113.

In addition, the reinforcing member 180 may be disposed at the top surface 110*a* and/or the bottom surface 110*c* of the case 110 in a state in which one side of the reinforcing member 130 is coupled to the flange 119. In a case in which the reinforcing member 180 is coupled to the flange 119, it is possible to more effectively prevent deformation of the edge of the opening 113.

The reinforcing member 180 may have various shapes of high resistance to bending stress. For example, the reinforcing member 180 may include a first member 181, a second member 183 spaced apart from the first member 181, and a connection member 185 connected between the first member 181 and the second member 183, the connection member 185 having a through hole 186, through which a bolt fastened to the case 119 is inserted. That is, the reinforcing member 130 may have a bracket shape of high resistance to bending stress. The case 110 is provided at a portion thereof corresponding to the through hole 136 with a boss 114, to which the bolt is fastened.

The first member 181 and the second member 183 may be disposed perpendicularly to the top surface of the case 110 to improve resistance to bending stress. That is, the first member 181 and the second member 183 may be disposed in the upward and downward direction of the case 110.

In addition, one end of the first member 181 and one end of the second member 183 may contact one surface of the case 110 while having the same height as the reinforcing rib 111 to reduce a space occupied by the reinforcing member 180. In this case, the connection member 185 may have the same height as the upper end of the reinforcing member 180.

The reinforcing member 180 may be made of a material having higher strength than the case 110. For example, the reinforcing member 180 may be made of a metal material or an alloy material. Specifically, the reinforcing member 180 may be made of at least one selected among steel, a steel alloy, an aluminum alloy, a titanium alloy, stainless steel, and a stainless steel alloy. However, the present invention is not limited thereto.

Figure 16:
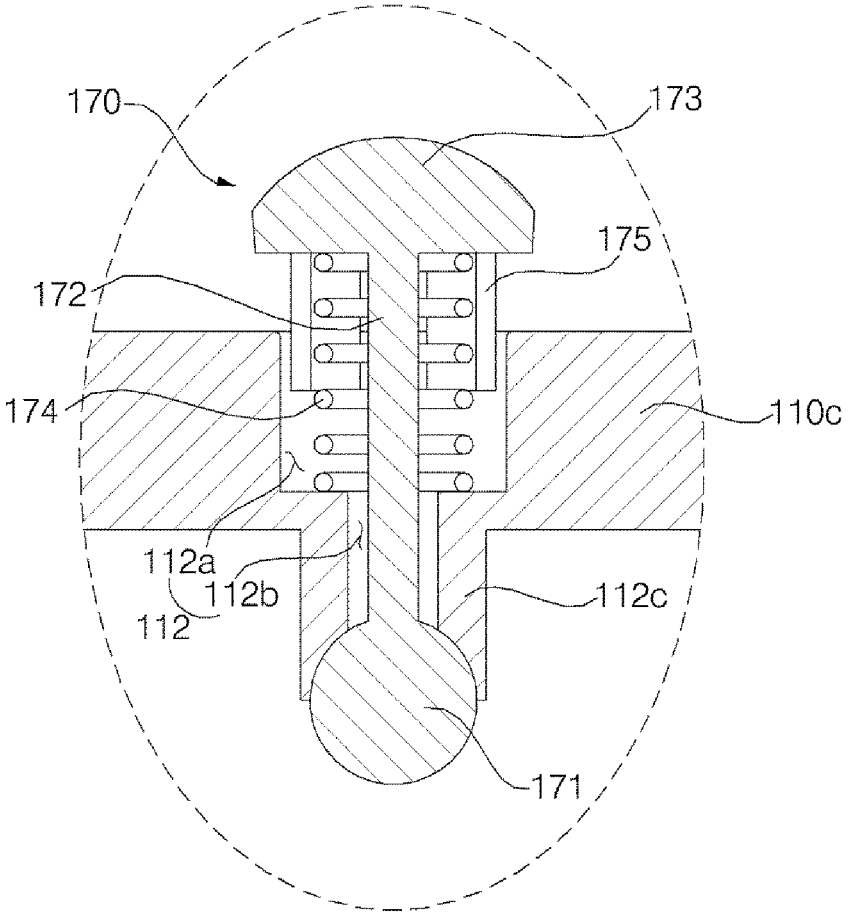
FIG. 16 is a magnified cross-sectional view illustrating an area B of FIG. 10.
Figure 17:
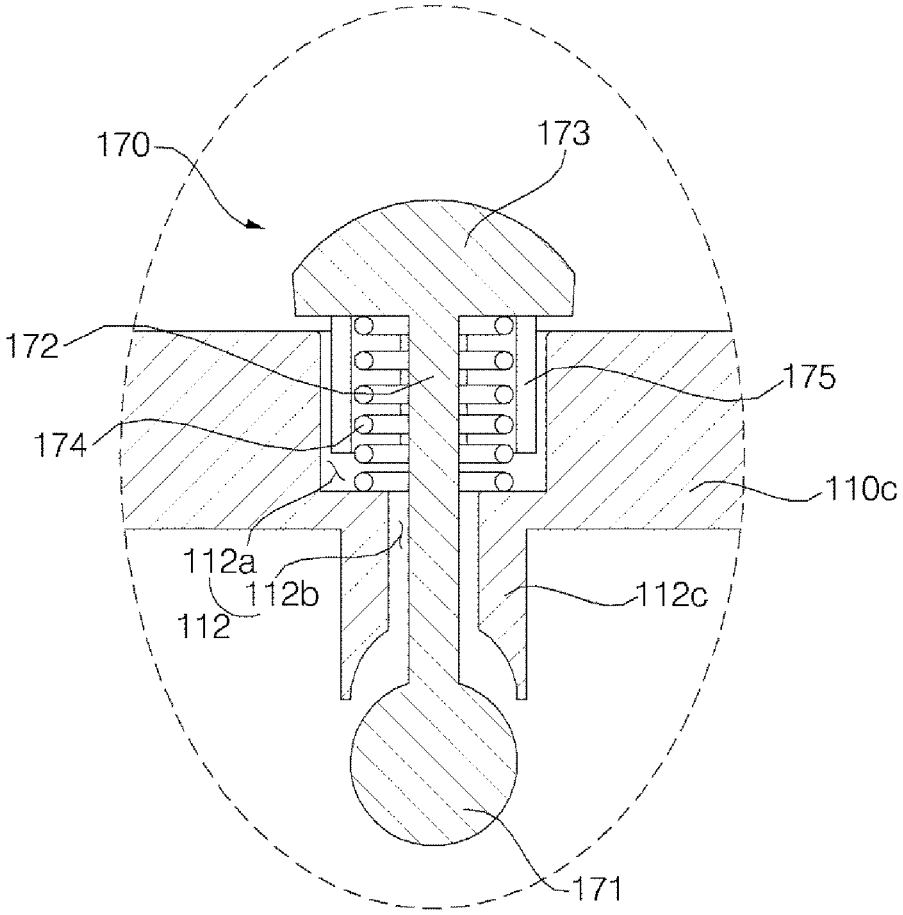
FIG. 17 is a cross-sectional view illustrating an open/close valve of FIG. 16 when the open/close valve is opened.
Figure 18:
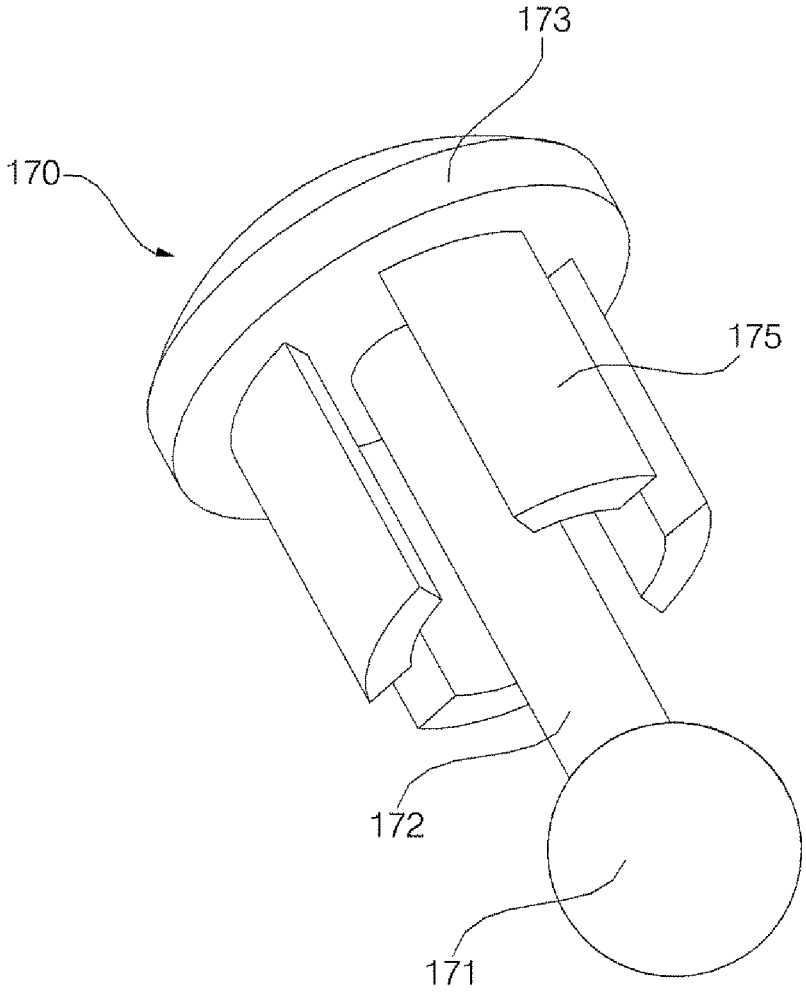
FIG. 18 is a perspective view illustrating an open/close valve according to an embodiment of the present invention.

FIG. 16 is an enlarged sectional view showing part B of FIG. 10, FIG. 17 is a sectional view showing a state in which an opening and closing valve of FIG. 16 is open, and FIG. 18 is a perspective view showing an opening and closing valve according to an embodiment of the present invention.

Referring to FIGS. 16 to 18, the discharge port 112 may include a water collection part 112*a* and a discharge part 112*b*.

As shown in FIG. 16, the discharge port 112 is a hole formed through the bottom surface 110*c* of the case 110. The shape of the discharge port 112 is not particularly restricted. The discharge port 112 may have various shapes so long as the discharge port 112 provides a water discharge channel. However, the discharge port 112 may have a shape corresponding to a valve shaft 172 of the opening and closing valve 170 such that the valve shaft 172 of the opening and closing valve 170 can reciprocate in the discharge port 112.

The water collection part 112*a* may be depressed in a portion of the bottom surface 110*c* of the case 110 to collect water in the case 110. The water collection part 112*a* is a part to which water formed in the case 110 flows along the inner surface of the case 110 such that the water is collected at the water collection part 112*a*. In addition, an elastic spring 174, which will hereinafter be described, is located in the water collection part 112*a* such that elastic force of the elastic spring 174 is supported by the water collection part 112*a*.

The discharge part 112*b* allows the water collection part 112*a* to communicate with the outside of the case 110 such that the water collected at the water collection part 112*a* can be discharged out of the case 110. The discharge part 112*b* may have a smaller width than the water collection part 112*a*. The width means a length in the left and right direction in FIG. 13. In addition, the discharge part 112*b* may have a smaller size or inner diameter than the water collection part 112*a*.

One end of the elastic spring 174 is located at a step (or the bottom of the water collection part 112*a*) formed by the difference in width between the water collection part 112*a* and the discharge part 112*b*.

More specifically, the water collection part 112*a* and the discharge part 112*b* may each be formed in the shape of a hole. The water collection part 112*a* and the discharge part 112*b* may have the same central axis. The outer diameter of the water collection part 112*a* may be greater than the outer diameter of the discharge part 112*b*. That is, the water collection part 112*a* may be depressed in a portion of the bottom surface 110*c* of the case 110 and the discharge part 112*b* may be formed through the bottom surface of the water collection part 112*a* such that the discharge part 112*b* communicates with the outside of the case 110.

For example, the discharge part 112*b* may be a through hole formed through the bottom of the water collection part 112*a*. In another example, the discharge part 112*b* may be a hole formed by a boss 112*c* protruding downward from the bottom surface 110*c* of the case 110.

The boss 112*c* may be integrally formed with the case 110. Alternatively, the boss 112*c* may be separately manufactured and then coupled to the case 110. The boss 112*c* protrudes downward from the bottom surface 110*c* of the case 110 to provide a space into which a plug 171 of the opening and closing valve 170 is inserted such that the plug 171 of the opening and closing valve 170 can hermetically seal the boss 112*c*.

For example, an empty space, in which the discharge port 112*b* is defined, is provided in the boss 112*c*. The opening and closing valve 170 reciprocates in the empty space. Water is discharged from the case 110 through the empty space. In addition, a hermetical sealing surface corresponding to the plug 171 may be formed at the surface of the boss 112*c* contacting the plug 171.

More specifically, in a case in which the plug 171 is formed in a globular shape, the hermetical sealing surface may be depressed in one end of the boss 112*c*.

In addition, the boss 112*c* may be made of any one selected from among rubber, synthetic resin, and silicone to increase hermetical sealing force. Of course, the boss 112*c* may be made of the same material as the case 110.

In this embodiment, the opening and closing valve 170 may reciprocate in the discharge port 112 to open and close the discharge port 112. In addition, the opening and closing valve 170 may be moved to one side by external force such that the opening and closing valve 170 is opened and the opening and closing valve 170 may be moved to the other side by elastic force such that the opening and closing valve 170 is closed. For example, the opening and closing valve 170 may be moved to one side by contact with the drawer 120' such that the opening and closing valve 170 is opened and the opening and closing valve 170 may be moved to the other side by elastic force such that the opening and closing valve 170 is closed.

The position of the opening and closing valve 170 is not particularly restricted. The opening and closing valve 170 may be disposed adjacent to the opening 113 of the case 110. In a case in which the opening and closing valve 170 is disposed adjacent to the opening 113 of the case 110, the opening and closing valve 170 cannot be observed by the naked eye unless the drawer is completely separated from the case 110.

For example, the opening and closing valve 170 may include a plug 171, a head 173, a valve shaft 172, and an elastic spring 174.

The plug 171 reciprocates upward and downward to open and close the discharge part 112*b*.

The plug 171 may have various shapes to open and close the discharge part 112*b* and to hermetically seal the discharge part 112*b*. For example, the plug 171 may have a larger width (or outer diameter) than the discharge part 112*b*. The plug 171 may be formed in a globular shape. Of course, the hermetical sealing surface may be formed at one side of the boss 112*c* which the plug 171 contacts. In addition, the plug 171 may be located outside the case 110. In another example, the plug 171 may have a larger width (or outer diameter) than the discharge part 112*b* and a smaller width (or outer diameter) than the boss 112*c* such that the plug 171 can be inserted into the boss 112*c* when the discharge part 112*b* is hermetically sealed by the plug 171.

The plug 171 may be made of rubber or silicone to increase hermetical sealing force with the discharge part 112*b*.

The valve shaft 172 is connected to one end of the plug 171.

One end of the head 173 may be connected to the valve shaft 172. The head 173 may have a larger width than the valve shaft 172. The head 173 may be located in the case 110. Specifically, the head 173 may be located on the water collection part 112*a* of the discharge port 112. The width of the head 173 may be greater than the width of the valve shaft 172 and the width of the water collection part 112*a*. That is, the width of the head 173 may be greater than the width of the valve shaft 172 to provide a space in which the elastic spring fitted on the valve shaft 172 is supported. In addition, the width of the head 173 may be greater than the width of the water collection part 112*a* such that the head 173 serves as a stopper caught by the bottom surface 110*c* of the case 110 when the opening and closing valve 170 reciprocates upward and downward. Of course, the head 173 prevents the introduction of foreign matter into the water collection part 181.

The head 173 may further include a plurality of introduction preventing pieces 175 to prevent the introduction of foreign matter having a predetermined size or more. As shown in FIG. 18, the introduction preventing pieces 175 may be disposed around the head 173 such that the introduction preventing pieces 175 are spaced apart from each other. The introduction preventing pieces 175 may extend from the head 173 to the water collection part 112*a*. That is, the introduction preventing pieces 175 may be disposed at the bottom surface of the head 173 in a state in which the introduction preventing pieces 175 are adjacent to the edge thereof such that the introduction preventing pieces 175 are spaced apart from each other. A spacing distance between adjacent ones of the introduction preventing pieces 175 may be adjusted to adjust the size of foreign matter prevented from being introduced into the water collection part 181.

During reciprocation of the opening and closing valve 170, the introduction preventing pieces 175 may reciprocate in the water collection part 112*a* to also perform a guide function.

The head 173 may contact the bottom surface of the drawer 120' during movement of the drawer 120'. Specifically, when the drawer 120' is moved, the bottom surface of the receiving part 124 comes into contact with the head 173 with the result that the head 173 is pushed. When the head 173 is pushed, the opening and closing valve 170 is opened.

The top surface of the head 173 may have a round shape protruding upward to minimize contact with the drawer 120' during movement of the drawer 120'.

The valve shaft 172 is connected between the plug 171 and the head 173. The valve shaft 172 extends through the discharge port 112. That is, the valve shaft 172 reciprocates the plug 171 and the head 173 connected to one end and the other end thereof while reciprocating in the discharge port 112. As a result, the reciprocation of the head 173 is transmitted to the plug 171 via the valve shaft 172.

Specifically, the valve shaft 172 may have a smaller width than the head 173 and the plug 171. In addition, the valve shaft 172 may have a smaller width (or outer diameter) than the water collection part 112*a* and the discharge part 112.

The elastic spring 174 is provided in the discharge port 112 to apply elastic force to reciprocation of the opening and closing valve 170. Specifically, one end of the elastic spring 174 contact the head 173 and the other end of the elastic spring 174 contact the step defined between the water collection part 112*a* and the discharge part 112*b*. In addition, the elastic spring 174 is located in the water collection part 112*a*. The elastic spring 174 provides restoring force to restore the opening and closing valve 170 to the interior of the case 110.

Hereinafter, operation of the opening and closing valve 170 will be described with reference to FIGS. 16 and 17.

Referring to FIG. 16, in an initial stage, the plug 171 and the discharge part 112*b* is in a hermetically sealed state by elastic force of the elastic spring 174. As a result, the interior of the case 110 is maintained in a low vacuum state.

Referring to FIG. 17, the head 173 is moved downward as external force is applied to the head 173 (for example, the drawer 120' contacting the head 173). As a result, the head 173 moves the valve shaft 172 and the plug 171 downward. At this time, the plug 171 becomes spaced apart from the discharge part 112*b* with the result that water is discharged from the case 110 through the discharge part 112*b*.

Figure 19:
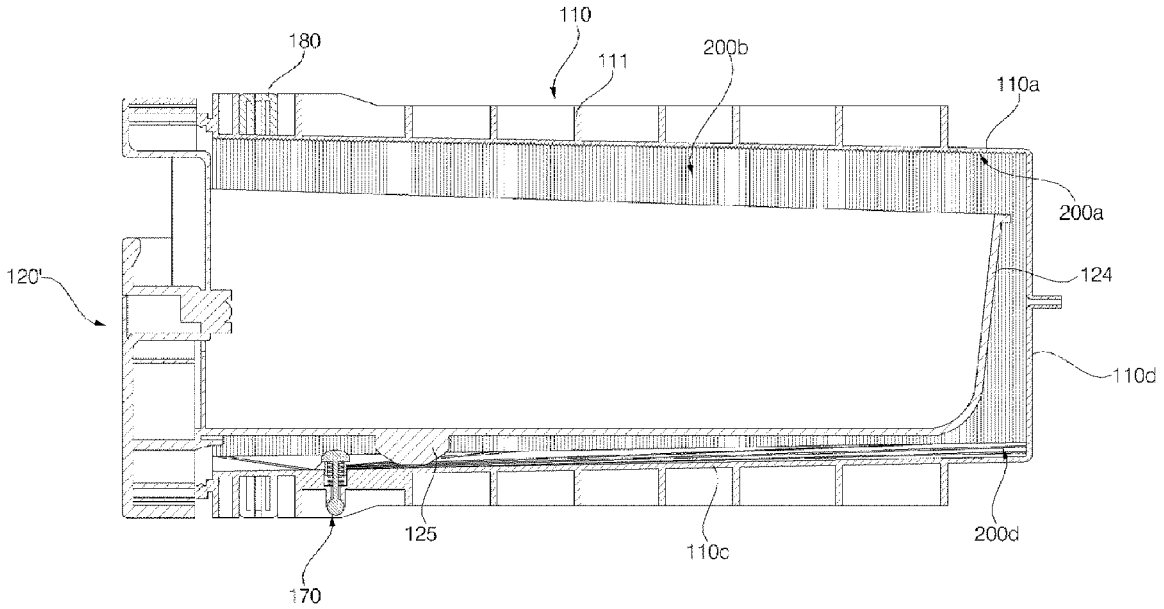
FIGS. 19 and 20 are views illustrating an operation of an open/close valve according to an embodiment of the present invention.
Figure 20:
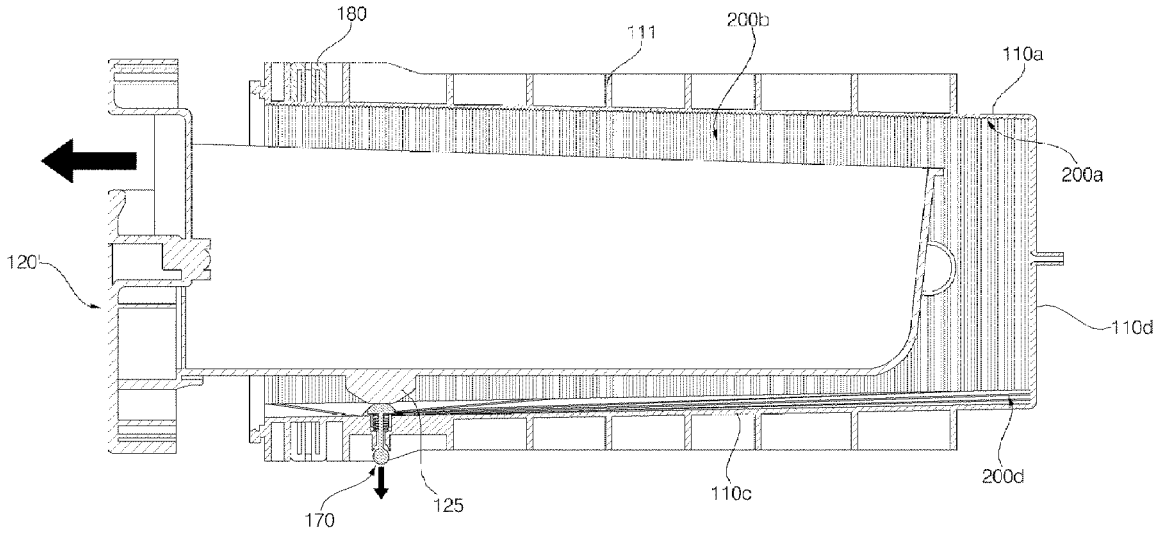

FIGS. 19 and 20 are views illustrating operation of the opening and closing valve according to the embodiment of the present invention.

Referring to FIG. 19, the bottom surface of the drawer 120' comes into contact with the head 173 during movement of the drawer 120'. Specifically, when the bottom surface of the receiving part 124 of the drawer 120' comes into contact with the head 173 during movement of the bottom surface of the receiving part 124 of the drawer 120', the head 173 is pushed to open the opening and closing valve 170.

The drawer 120' may be further provided at the bottom surface thereof (specifically, the bottom surface of the receiving part 124 thereof) with a push part 125 that can make contact with the head 173. During movement of the drawer 120', the push part 125 comes into contact with the head 173 to push the head 173. The push part 125 may protrude below the receiving part 124.

In an initial stage, the case 110 is hermetically sealed by the drawer 120' and the interior of the case 110 is maintained in a low vacuum state. The opening and closing valve 170 is maintained in a closed state (a state in which the discharge part 112*b* is hermetically sealed by the plug 171) by elastic force of the elastic spring 174.

FIG. 20 is a sectional view showing a state in which the drawer 120' is opened from the case 110.

The drawer 120' is opened in which the low vacuum state of the interior of the case 110 is released. At this time, the drawer 120' moves to the front of the case 110 and the push part 125 pushes the head 173 of the opening and closing valve 170.

In this embodiment, therefore, the discharge port 112 is hermetically sealed by the opening and closing valve 170 due to elastic force of the elastic spring 174 at a normal time with the result that the interior of the case 110 is maintained in a low vacuum state. When the drawer 120' is opened, on the other hand, the opening and closing valve 170 is automatically opened to discharge water formed in the case 110 to the outside.

In addition, in this embodiment, it is possible to discharge water formed in the case 110 to the outside through simple opening and closing of the drawer 120' based on the simple structure without additional control.

Figure 21:
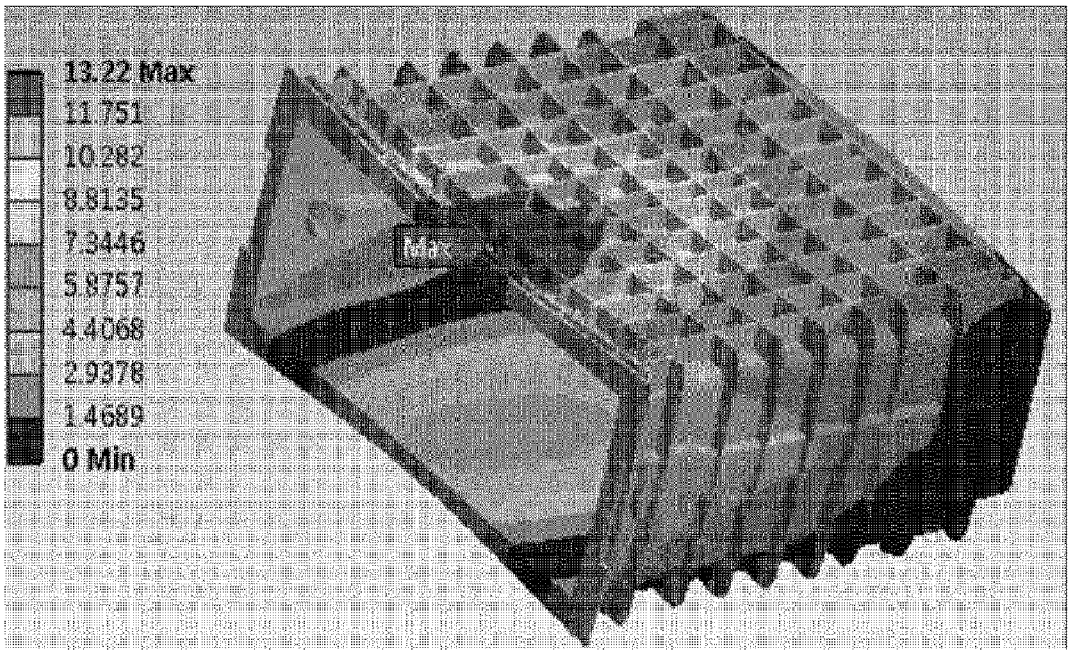
FIG. 21 is a view illustrating a deformation degree of a case according to a comparative example.
Figure 22:
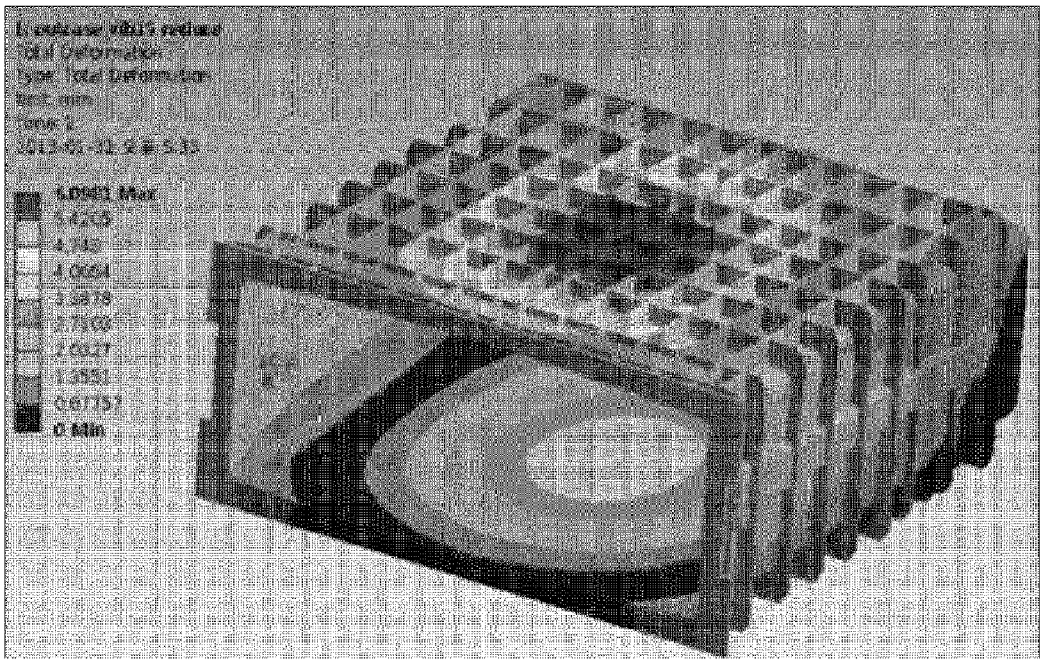
FIG. 22 is a view illustrating a deformation degree of a case according to an embodiment of the present invention.
Figure 23:
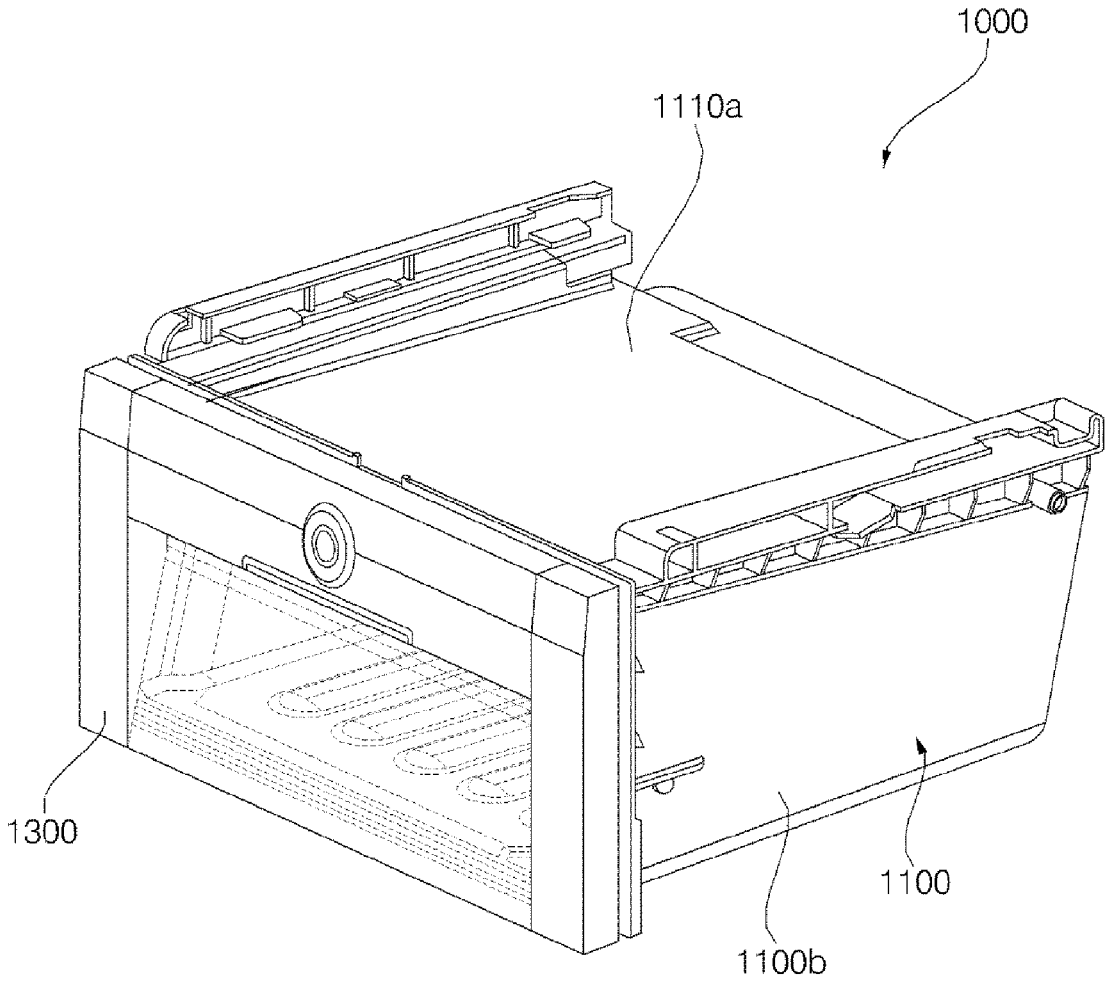
FIG. 23 (Related Art)
FIG. 23 is a perspective view illustrating a related art airtight container for a refrigerator.

FIG. 21 is a view showing a deformation degree of a case according to a comparative example and FIG. 22 is a view showing a deformation degree of the case according to the embodiment of the present invention.

FIG. 21 shows a deformation degree of a case 110 according to a comparative example when negative pressure is generated in the case 110. The edge of the opening 113 is deformed due to the negative pressure in the case 110. In particular, the middle portion of the top surface of the edge of the opening 113 is greatly deformed by 13.22 mm. In this case, contact between the flange 119 of the opening 113 and the drawer 120 is released and external air is introduced into the case 110. Consequently, it is difficult to maintain the interior of the case 110 in a negative pressure state.

FIG. 22 shows a deformation degree of the case 110 according to embodiment of the present invention when negative pressure is generated in the case 110. In the same negative pressure as in the comparative example, the middle portion of the top surface of the edge of the opening 113 is deformed by about 1.5 mm. As a result, contact between the flange 119 of the opening 113 and the drawer 120' is maintained and external air is not introduced into the case 110. Consequently, it is possible to maintain the interior of the case 110 in a negative pressure state and to store vegetables in the case 110 in a fresh state.

Since the ventilation port opening/closing member ventilating the airtight container of the refrigerator and the drawer move in the same direction, the ventilation port opening/closing member and the drawer can be moved by a force applied on the same direction. Accordingly, the embodiments present invention has an effect in that the drawer can be together withdrawn with a force applied for the operation of the ventilation port opening/closing member.

One effect is that the edge of an opening of a case is designed to have an arch structure to prevent the circumference of the opening of the case from being bent inside the case.

In addition, another effect is that a flange is formed at the edge of the opening to prevent the edge of the opening from drooping and to provide a contact surface between a hermetical sealing member and a drawer.

In addition, another effect is that a reinforcing member is coupled adjacent to the edge of the opening to reduce deformation of the edge of the opening.

In addition, another effect is that deformation of the edge of the opening is restrained, whereby it is possible to continuously maintain the interior of a vegetable container in a low vacuum state.

In addition, another effect is that dew formed on the inner surface of the case moves to valley parts along guide channels formed at the inner surface of the case, whereby the dew cannot be observed by the naked eye.

In addition, another effect is that the top surface of the case is inclined downward to lateral surfaces of the case, whereby dew formed on the top surface of the case can be effectively guided to the lateral surfaces of the case due to gravity.

In addition, another effect is that the bottom surface of the case is inclined downward to a water collection part, whereby water guided from the top surface and the lateral surfaces of the case can effectively flow to the water collection part.

In addition, another effect is that an opening and closing valve is disposed in a discharge port, whereby water can be easily discharged from the case.

In addition, another effect is that the discharge port is hermetically sealed by the opening and closing valve due to external force of an elastic spring at a normal time, whereby the interior of the case is maintained in a low vacuum state and, when the drawer is opened, the opening and closing valve is automatically opened to discharge water formed in the case to the outside In addition, another effect is that the opening and closing valve is disposed adjacent to the opening of the case, whereby the opening and closing valve cannot be observed by the naked eye unless the drawer is completely separated from the case and thus the aesthetical appearance is improved.

In addition, another effect is that water formed in the case can be discharged to the outside through simple opening and closing of the drawer based on a simple structure without additional control.

In addition, another effect is that a user can easily release the weak vacuum state of the inside of the case by pressurizing the operation switch before the drawer is opened.

In addition, another effect is that the drawer can be easily opened with a simple configuration.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A refrigerator comprising:

a case having a storage space formed therein;

a drawer to store food and opening and closing the storage space while being supported by the case so as to be movable in a straight-line direction with respect to the case, the drawer comprising a ventilation port to ventilate the storage space; and a ventilation port opening/closing member for opening or closing the ventilation port, wherein the ventilation port opening/closing member moves in a straight-line direction in the direction as the drawer moves to be withdrawn from the case to open the ventilation port.

2. The refrigerator of claim 1, wherein the ventilation port opening/closing member is movably supported in a straight-line direction by the drawer.

3. The refrigerator of claim 2, wherein after the ventilation port is opened by the moving of the ventilation port opening/closing member, the drawer is movable together with the ventilation port opening/closing member by a force acting on the ventilation port opening/closing member.

4. The refrigerator of claim 1, wherein the ventilation port opening/closing member comprises a sealing protrusion insertable into the ventilation port to seal the ventilation port, and the sealing protrusion is withdrawable from the ventilation port according to a movement of the ventilation port opening/closing member.

5. The refrigerator of claim 4, further comprising an elastic member that elastically supports the ventilation port opening/closing member.

6. The refrigerator of claim 5, wherein the elastic member is elastically deformed when the ventilation port opening/closing member is moved by a force and the sealing protrusion is withdrawn from the ventilation port, and when the force applied to the ventilation port opening/closing member is removed, the ventilation port opening/closing member is restored to an original location by a restoring force of the elastic member.

7. The refrigerator of claim 5, wherein the elastic member is connected between the ventilation port opening/closing member and the drawer.

8. The refrigerator of claim 4, wherein:

the case has an opening;

the drawer comprising:

a receiving part forming a receiving space for stored goods and insertable into the opening; and an airtight container door disposed at a front side of the receiving part to open and close the opening;

the airtight container door comprising:

a door frame having a rear surface to cover the opening; and a door panel disposed at a front surface of the door frame;

the ventilation port is formed in the door frame; and the sealing protrusion is movable at a rear side of the door panel and is covered by the door panel so as not to be exposed to the outside.

9. The refrigerator of claim 4, further comprising a sealer formed of a flexible material and having a tubular shape inserted into the ventilation port, wherein the sealing protrusion is insertable into the sealer.

10. The refrigerator of claim 9, wherein the sealer has one end facing the storage space and comprises one or more cut portions thereof.

11. The refrigerator of claim 1, wherein the ventilation port opening/closing member comprises:

a grip part vertically extending from a location laterally spaced from the sealing protrusion; and a connection part connecting the sealing protrusion and the grip part in a lateral direction.

12. The refrigerator of claim 11, wherein the grip part comprises a stopping protrusion formed on a rear portion thereof and having a curved shape at a contact portion with a finger to allow the finger of a user to grip the grip part.

13. The refrigerator of claim 1, wherein the ventilation port opening/closing member comprises a support protrusion protruding downward, and the drawer has a guide groove formed to support the support protrusion and guide a movement of the support protrusion.

14. The refrigerator of claim 1, wherein when the ventilation port opening/closing member is pulled, the ventilation port opening/closing member moves independently of the drawer to open the ventilation port, and when the ventilation port opening/closing member is further pulled in a state where the ventilation port is opened, the ventilation port opening/closing member pulls against the drawer to move together with the ventilation port opening/closing member.

15. The refrigerator of claim 1, wherein the case further comprises:

a discharge port formed through a bottom surface of the case such that water collected in the case is discharged out of the case; and an opening/closing valve opening the discharge port when an external force is applied to the opening/closing valve and closing the discharge port by being restored to an original location by an elastic force of an elastic member disposed at the opening/closing valve when the external force is removed.

16. The refrigerator of claim 15, further comprising a guide channel formed in an inner surface of the case to guide water collected in the case to the discharge port.

17. The refrigerator of claim 16, wherein the guide channel comprises at least two mountain parts protruding toward the inside of the case and at least one valley part disposed between the respective mountain parts and depressed toward the outside of the case.

18. The refrigerator of claim 15, wherein the bottom surface of the case is downwardly inclined toward the discharge port.

19. The refrigerator of claim 15, further comprising a reinforcing part for reinforcing a strength of the case, wherein the reinforcing part is coupled to the case at a location adjacent to the opening of the case in which the drawer is inserted and comprises a reinforcing member having a strength larger than the case.

20. The refrigerator of claim 1, further comprising a vacuum pump to lower pressure in the case.

* * * * *